US012326076B2

(12) United States Patent
Ripple et al.

(10) Patent No.: US 12,326,076 B2
(45) Date of Patent: Jun. 10, 2025

(54) HYDRAULIC FRACTURING MISSILE AND RELATED APPARATUS AND METHODS

(71) Applicant: Paloma Pressure Control LLC, Midland, TX (US)

(72) Inventors: Robert Ripple, Richmond, TX (US); Bryan Wilborn, Midland, TX (US); Roman Eddie Cline, Midland, TX (US)

(73) Assignee: Paloma Technology Holdings LLC., Midland, TX (US)

( * ) Notice: Subject to any disclaimer, the term of this patent is extended or adjusted under 35 U.S.C. 154(b) by 0 days.

(21) Appl. No.: 18/829,831

(22) Filed: Sep. 10, 2024

(65) Prior Publication Data

US 2025/0084745 A1 Mar. 13, 2025

Related U.S. Application Data

(60) Provisional application No. 63/537,630, filed on Sep. 11, 2023.

(51) Int. Cl.
*E21B 43/26* (2006.01)

(52) U.S. Cl.
CPC ..... *E21B 43/2607* (2020.05)

(58) Field of Classification Search
CPC ..... E21B 43/2607
See application file for complete search history.

(56) References Cited

U.S. PATENT DOCUMENTS

| | | | | |
|---|---|---|---|---|
| 9,222,346 | B1 * | 12/2015 | Walls | E21B 43/2607 |
| 2003/0117890 | A1 * | 6/2003 | Dearing | E21B 43/2607 366/182.2 |
| 2007/0125544 | A1 * | 6/2007 | Robinson | E21B 43/30 166/305.1 |
| 2012/0181013 | A1 * | 7/2012 | Kajaria | E21B 43/2607 166/79.1 |
| 2013/0175038 | A1 * | 7/2013 | Conrad | E21B 34/14 166/308.1 |
| 2015/0000766 | A1 * | 1/2015 | Arizpe | F16F 7/14 137/561 A |
| 2016/0376864 | A1 * | 12/2016 | Roesner | E21B 33/068 166/308.1 |
| 2017/0122060 | A1 * | 5/2017 | Dille | E21B 43/2607 |
| 2018/0187662 | A1 * | 7/2018 | Hill | F04B 47/02 |

* cited by examiner

*Primary Examiner* — James G Sayre
(74) *Attorney, Agent, or Firm* — E. Randall Smith; E. Randall Smith, P.C.

(57) ABSTRACT

Improved hydraulic fracturing missiles and related systems, apparatus and methods are provided. Certain embodiments involve the low pressure side of a frac missile including a first suction conduit having multiple suction conduit spools releasably, longitudinally, mechanically and fluidly interconnectable and separable without welding and at least one respective suction inlet and outlet releasably mechanically and fluidly connectable to and separable from the first suction conduit without welding.

22 Claims, 12 Drawing Sheets

HYDRAULIC FRACTURING MISSILE AND RELATED APPARATUS AND METHODS

CROSS REFERENCE TO RELATED APPLICATIONS

The present application claims priority to U.S. Provisional Patent Application Ser. No. 63/537,630 filed on Sep. 11, 2023 and entitled "Systems, Apparatus & Methods for Fluidly Connecting One or More Frac Blenders with One or More Frac Pumps", the entire contents of which are hereby incorporated by reference herein.

FIELD OF THE DISCLOSURE

The present disclosure relates generally to improved hydraulic fracturing missiles and related systems, apparatus and methods.

BACKGROUND

Hydraulic fracturing operations typically involve the use of a hydraulic fracturing missile ("frac missile"), sometimes referred to as a frac pump output header. The frac missile is often described as a flow control unit used in the pressurization of fluid employed in hydraulic fracturing. The frac fluid will normally enter the frac missile at low pressure from a frac blender or other source(s), be directed to one or more frac pumps (typically on trucks) for pressurization, returned to the frac missile and then directed to the well(s) or other equipment.

Frac missiles typically includes a (i) low-pressure (LP) side having one or more LP fluid flow lines for receiving frac fluid from the blender(s) or other source and directing it to the frac pumps and (ii) a high-pressure (HP) side having one or more HP fluid flow lines for receiving the frac fluid from the pumps and directing it to the well(s) or other destination (s). The LP and HP lines often extend across multiple support structures, or skids, and are made up of a series of components coupled together. For example, the LP line typically includes a blender manifold having ports, or inlets, for coupling to the frac blender(s) and a series of outlets for coupling to the frac pumps. The HP line usually also includes inlets and outlets.

Many known presently available frac missiles are believed to have one or more disadvantages. For example, components included in the LP lines are often formed or coupled together using welds. Welded components and connections in the LP line can have or cause any number of problems. For example, the welds can be subject to weakening, degradation and failure (e.g., leakage, stress cracking, blistering, breakage) due to contact with acid, hydrogen sulfide or other chemicals or substances that may be present in fluid flowing therethrough or in the area of operation. For another example, the abrasive nature of frac proppant, or sand, in the frac fluid traveling under pressure (e.g., 200 psi or more) through the LP line can wear down, penetrate (e.g., with pin holes) or wash out the welds, causing premature failure of the LP line. In fact, welds can be the weakest points along the LP line and often the first part of LP line to leak, fail or require repair. Thus the life of the LP line and its components and the frac missile is limited when welds are used.

For a further example, when it is desirable or necessary to replace, change, reconfigure or modify weld-connected components of the LP line(s), or to patch or repair a compromised weld, operations will typically need to be shut down for an extended period, the work area needs to be inspected and cleared of gas and other ignitable sources and made safe for welding, hot permits for welding on the site may need to be obtained and one or more welders brought in. Often, an LP line with welds requires rewelding again and again, causing substantial down time and expense.

For yet another example, many known frac missiles include only a single blender manifold, limiting the number of inlets or ports to the LP line(s). For still another example, the blender manifolds (e.g., a rounded pipe) on many presently known frac missiles have limited space that allows only a fixed number of ports, or inlets, limiting the versatility and use of the frac missile. Often, the inlets are welded to the blender manifold, requiring the same time consuming, costly, burdensome process and limitations described above in order to add or replace inlets, provide different sized inlets and the like. Thus, many known conventional blender manifolds cannot be easily modified to change out or add inlets to the LP line(s). For another example, conventional frac missiles usually require a valve associated with the LP side to be able to separate flow of frac slurry and clean water, when desired. The necessity of requiring a valve can lead to problems, such as the valve washing out or malfunctioning. For yet a further example, the outlets on the LP line are often welded thereto, requiring the same process and limitations as above to provide different sized outlets, add or replace outlets and the like.

For still another example, various components on the frac missile may be unique or arranged in a unique manner, not be interchangeable and, consequently, cannot be easily interchanged or switched out with an on-hand replacement. In many cases, to change the length of a conventional LP line or add inlets or outlets thereto can require cutting and welding to extend or reduce pipe. Likewise, the different skids used in a conventional frac missile are often unique, differing from one another and not being interchangeable, requiring substantial time and effort to create a replacement or convert any of the skids for use at another location in the frac missile.

Many of the same or similar disadvantages and limitations as described above may exist for the HP lines currently used on various conventional frac missiles.

Accordingly, there exists a need for improved hydraulic fracturing missiles and related systems, apparatus and methods.

It should be understood that the above-described disadvantages, limitations, features, capabilities, examples, advantages and other details are provided for illustrative purposes only and are not intended to limit the scope or subject matter of this disclosure or the appended claims. Thus, none of the appended claims should be limited by the above discussion or construed to address, include or exclude each or any of the above-cited disadvantages, limitations, features, capabilities, examples, details or advantages merely because of their mention above.

BRIEF SUMMARY OF EXEMPLARY EMBODIMENTS

The present disclosure is directed to systems, apparatus and methods involving improved hydraulic fracturing missiles having one or more missile skids that carry one or more LP lines and/or HP lines and, depending upon the particular application, circumstances and other variables, possess one or more of the attributes, features or capabilities mentioned below, described or shown elsewhere in this patent, or which may be apparent therefrom: the frac missile may be entirely weldless; the frac missile may be mostly, or partially, weldless; the assembly, disassembly, repair and maintenance of the frac missile and/or missile skid(s) may require no welding or less welding than with conventional frac missiles and missile skids, saving time, cost, complexity of operations, job interruption and manpower; the frac missile and/or missile skid(s) may have all, substantially all or many weldless connections and weld-free components that will last longer than welded connections and components and increase the lifespan of the frac missile and/or missile skid(s), eliminate the need to obtain welding permits and inspect job sites to clear out gas and other ignitable sources, reduce down time, manpower, potential safety hazards, maintenance and repairs, be easier to assemble, disassemble, repair and reconfigure or a combination thereof; the frac missile and/or missile skid(s) may be quickly and easily assembled, modified and disassembled with all or mostly mechanical connections; multiple missile skids may be identical, interchangeable and reversible; any missile skid may be used at any location or position in a frac missile; the missile skid(s) may be modular for interconnection in any configuration to form and be easily added to and removed from a frac missile without welding; the frac missile and/or missile skid(s) may be easily configured, reconfigured or modified to accommodate any desired number and type of frac pumps on one or both sides of the skid and any desired number and location of blenders without welding; each missile skid's internal configuration may be easily changed and the skids may be interchangeable with each other in a frac missile without welding or with minimal welding; the missile skid(s) may be reversible or non-direction-specific so fluid may flow therethrough in either direction; each missile skid may be easily modified to serve or not serve as a blender skid with the addition or removal of one or more blender manifolds without welding; the missile skid(s) may provide split-stream flow or slurry-only mix with a two-piece blender block design without the need for a valve; each missile skid may be easily modified to serve or not serve as an end skid with the addition or removal of one or more end caps, blind flanges or other components without welding; the missile skid(s) may include multiple blender manifolds that are fluidly coupled together, selectively fluidly couplable together or fluidly isolated; the LP line(s) and/or HP lines may have all weldless connections; the LP line(s) and/or HP lines may have substantially all weldless connections; the inlets and outlets on the LP lines and/or HP lines may be easily added, removed, replaced or switched out without welding; the inlets and outlets on the LP lines and/or HP lines may be releasably mechanically coupled to the LP lines and/or HP lines; each LP line may be entirely weldless; each LP line may be partially weldless; each LP line may be made up of multiple components that are interconnectable and disconnectable without welding; each LP line may be shortened, lengthened or modified, and LP inlets and outlets added or removed, without welding; the components of each LP line may be connected and disconnected, added and removed, with mechanical connectors; a common form of mechanical connector may be used to connect and disconnect various, many or all of the different components of each LP line; each LP line may be constructed at least partially of interchangeable, common-sized spools; the spools may be constructed of hard piping or hose; the spools may be integrally formed without welding, such as through molding, casting, forging, machining or other processes; the spools may be formed as a solid forging with mechanical connectors, such as flanges, formed thereon or therein and without welding; the spools may be universal, reversible and interchangeable; the LP line(s) may have many or all interchangeable parts so that fewer spare parts need to be on hand at a job site; the LP line(s) may be easily modified to remove, replace or change the size of or add LP inlets and LP outlets without welding; everything mentioned above with respect to the LP line(s) and related components may be similarly applied to the HP line(s) and related components (to the extent useful for or compatible with HP flow and with any modifications needed for such uses) and is hereby incorporated by reference herein in its entirety as to the HP line(s) and related components; one or more blender manifolds may have one or more support surfaces to accommodate additional or fewer LP inlets and/or otherwise be scalable for easy addition and removal of LP inlets without welding; one or more blender manifolds may include one or more blender blocks to accommodate additional or fewer LP inlets and/or otherwise be scalable for easy addition or removal of LP inlets without welding; one or more blender blocks may be rectangular, square or otherwise have flat support surfaces; one or more blender manifolds or blender blocks may be integrally formed with machined inlets, or capable of carrying removable inlets, to avoid having to cut-out and weld LP inlets into place; one or more blender manifolds (e.g., blender blocks) may include one or more expansion/access ports for releasable mechanical connection of, or to accommodate, one or more blender block expanders or other components and/or allow access into the blender manifold; or a combination thereof.

In various embodiments, the present disclosure involves a hydraulic fracturing missile that includes a low pressure side having a first suction conduit, at least one suction inlet and at least one suction outlet. Each suction inlet is capable of fluidly coupling the first suction conduit to at least one frac blender and each suction outlet is capable of fluidly coupling the first suction conduit to at least one frac pump. Fluid can pass from the frac blender, through at least one suction inlet into the first suction conduit and thereafter through at least one suction outlet to at least one frac pump. The first suction conduit includes multiple suction conduit spools releasably, longitudinally, mechanically and fluidly interconnectable and separable without welding. Each suction inlet and outlet is releasably mechanically and fluidly connectable to and separable from the first suction conduit without welding.

Any of the following features are optional. The suction conduit spools may be reversible and interchangeable so that each suction conduit spool is releasably mechanically and fluidly connectable to and separable from any other suction conduit spool and can allow fluid flow therethrough in either direction. Each suction conduit spool may be releasably mechanically and fluidly connectable to and separable from any other suction conduit spool with at least one mechanical connector. The mechanical connector may include at least one fastener. The mechanical connector may include at least one receiver provided on at least one suction conduit spool and configured to receive at least one fastener. Each suction conduit spool may include at least one receiver formed integrally therewith. Each receiver may include at least one flange. A flange may be provided at or proximate to each end of each suction conduit spool. The respective flanges of each suction conduit spool may be forged therewith.

At least one suction outlet may be disposed on a suction outlet carrier. Each suction outlet carrier may be releasably mechanically and fluidly connectable to and separable from any suction conduit spool without welding. Each suction outlet carrier may be releasably mechanically and fluidly connectable to and separable from any suction conduit spool with at least one mechanical connector. At least one suction outlet carrier may be releasably mechanically and fluidly connectable between a pair of longitudinally aligned suction conduit spools and separable therefrom without welding.

At least one suction inlet may be disposed on a blender manifold configured to be releasably mechanically and fluidly connectable to and separable from at least one suction conduit spool without welding. The blender manifold may be releasably mechanically and fluidly connectable to and separable from at least one suction conduit spool with at least one mechanical connector. The blender manifold may include at least first and second separate and distinct support surfaces each being configured to host multiple suction inlets. The blender manifold may include at least one square or rectangular blender block having at least four sides, at least two of which have an at least substantially flat support surface configured to host multiple suction inlets.

The hydraulic fracturing missile may include a plurality of missile skids configured to be releasably, longitudinally interconnectable and separable without welding. The first suction conduit may extend at least partially across first and second missile skids and include at least first and suction suction conduit spools disposed upon the first missile skid and at least third and fourth suction conduit spools disposed upon the second missile skid. The first and second suction conduit spools may be releasably interconnectable and separable with at least one mechanical connector without welding and the third and fourth suction conduit spools being releasably interconnectable and separable with at least one mechanical connector without welding. The plurality of missile skids may be interchangeable, modular, reversible and longitudinally interconnectable in any order without welding.

Various embodiments of the present disclosure involve systems for forming a suction conduit for a hydraulic fracturing missile. These systems include a plurality of universal, interchangeable and reversible suction conduit spools configured to be releasably, longitudinally, mechanically and fluidly interconnectable and separable without welding. Each among a plurality of universal blender manifolds is configured to carry multiple suction inlets and be releasably, mechanically and fluidly engageable with and separable from any suction conduit spool without welding. Each among a plurality of universal, interchangeable and reversible suction outlet carriers carries at least one suction outlet and is releasably, mechanically and fluidly engageable with and separable from any suction conduit spool without welding.

If desired, the suction outlet carrier may be include a T-shaped pipe or conduit. In some instances, a plurality of universal, interchangeable, interconnectable mechanical connectors may be provided. At least one such mechanical connector may be provided at or near the first and second respective ends of each suction conduit spool and suction outlet carrier and at or proximate to one end of each blender manifold so that any blender manifold can be coupled to either end of any suction conduit spool and either end of any suction outlet carrier can be coupled to either end of any suction conduit spool. The mechanical connector may include at least one flange.

Accordingly, the present disclosure includes features and advantages which are believed to enable it to advance hydraulic fracturing systems, apparatus and methods. Characteristics and advantages of the present disclosure described above and additional features and benefits will be readily apparent to those skilled in the art upon consideration of the following detailed description of various embodiments and referring to the accompanying drawings.

BRIEF DESCRIPTION OF THE DRAWINGS

The following figures are part of the present specification, included to demonstrate certain aspects of various embodiments of this disclosure and referenced in the detailed description herein.

DETAILED DESCRIPTION OF EXEMPLARY EMBODIMENTS

Figure 1:
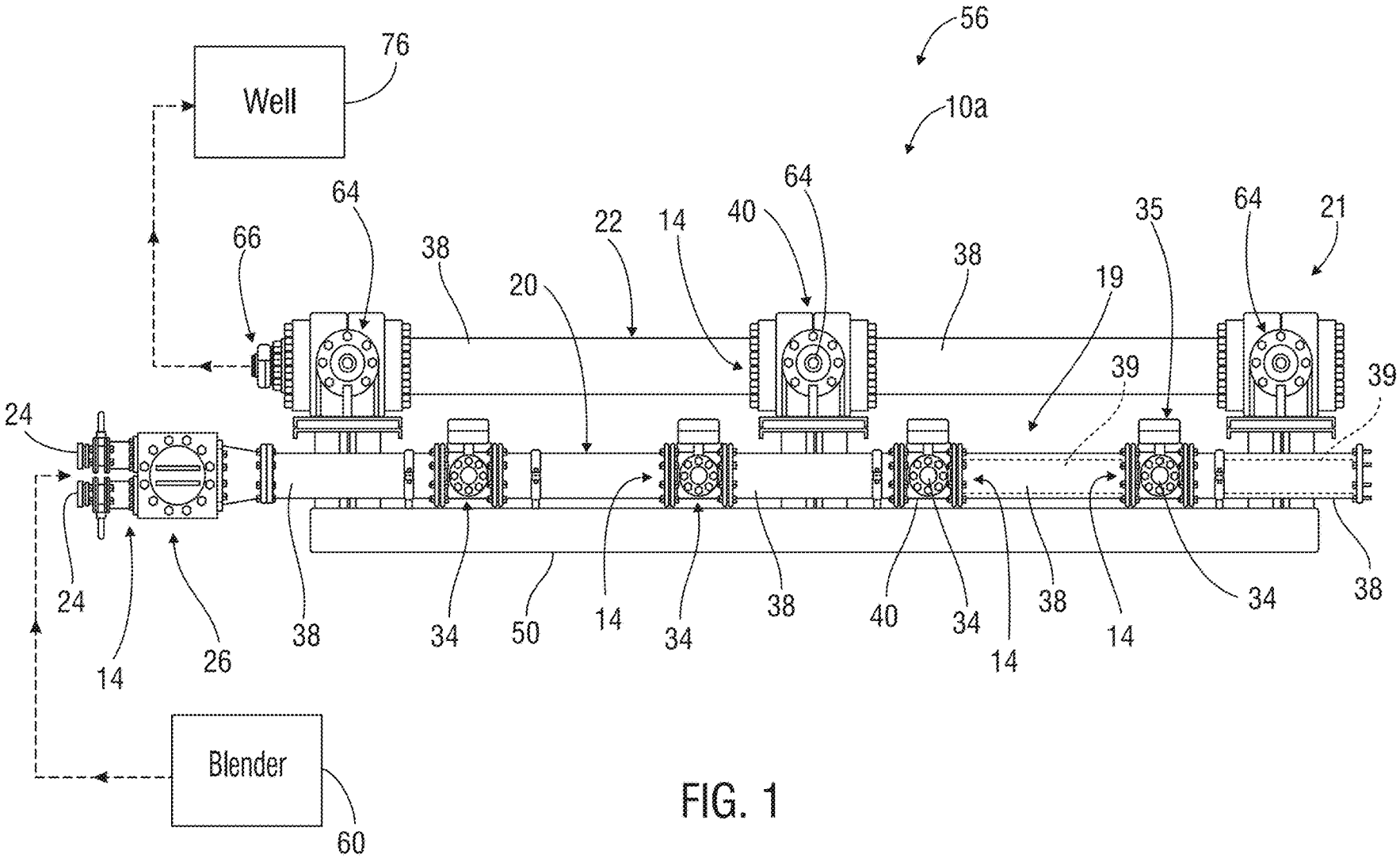
FIG. 1 is a side view of an exemplary frac missile skid in accordance with one or more embodiments of the present disclosure.

Characteristics and advantages of the present disclosure and additional features and benefits will be readily apparent to those skilled in the art upon consideration of the following detailed description of exemplary embodiments and referring to the accompanying figures. It should be understood that the description herein and appended drawings are of exemplary embodiments and not intended to limit the claims of this patent (or any patent or patent application related hereto). On the contrary, the intention is to cover all modifications, equivalents and alternatives falling within the spirit and scope of this disclosure and the claims. Many changes may be made to the particular embodiments and details disclosed herein without departing from such spirit and scope.

In showing and describing preferred embodiments in the appended figures, common or similar components, features and elements are referenced with like or identical reference numerals or are apparent from the figures and/or the description, claims and other parts of this patent. The figures are not necessarily to scale and certain features and certain views of the figures may be shown exaggerated in scale or in schematic in the interest of clarity and conciseness.

When reference numbers are followed by a lowercase letter (e.g., first and second connectors 117A, 117B), they are each the same type of component or item (e.g., a connector 117) having the same features, but having a different location, use or other characteristic(s). In some instances, the drawings or discussion herein may include only reference numerals followed by lowercase letters (e.g., first and second connectors 117A, 117B), without any separate reference to the primary feature alone (e.g., connector 117). In those cases, it should be presumed that the referenced items (e.g., first and second connectors 117A, 117B) are examples of the primary feature (e.g., connector 117), even though the primary feature is not referenced separately.

As used herein and throughout various portions (and headings) of this patent (including the claims), the terms "invention", "present invention" and variations thereof are not intended to mean every possible embodiment encompassed by this disclosure or any particular claim(s). Thus, the subject matter of each such reference should not be considered as necessary for, or part of, every embodiment hereof or of any particular claim(s) merely because of such reference.

The terms "including" and "comprising" are used herein and in the appended claims in an open-ended fashion and thus should be interpreted to mean "including, but not limited to". Reference herein and in the appended claims to components, features, aspects, etc. in a singular tense does not necessarily limit the present disclosure or appended claims to only one such component, feature or aspect, but should be interpreted generally to mean one or more, except and only to the extent as may be expressly specified otherwise herein or in any particular claims hereof and only for such specific references or claims and other claims depending therefrom. Accordingly, the use of "a", "an" or "the" before a noun refers to and should be interpreted to mean "one or more", except and only to the extent as may be expressly specified otherwise. For example, a recitation in the description or claims herein of "a connector coupled between X and Y" should be construed to mean that "one or more connectors is coupled between X and Y", unless a different construction is expressly provided. Also, the use of "(s)" in reference to an item, aspect, component, feature, action, etc. (e.g., "surface(s)") should be construed to mean "at least one".

The use of "or" herein provides alternate possibilities, only one of which may be present. All such possibilities do not need to be available. For example, if an embodiment of a component is described as "having a collar or coupling", it may include only one or more collars, only one or more couplings or at least one of each. The use of "or" herein thus does not require all of the possibilities be available, just any one or more of them. Similarly, the use of "and/or" herein provides for numerous possibilities, only one of which may be present. All the possibilities do not need to be available—only any one of them. For example, if an embodiment of a component is described as "having a collar and/or a coupling", it may include only one or more collars, only one or more couplings or at least one of each. Thus, the use of "and/or" herein does not require all the possibilities, just any one or more of them.

The phrase "at least one among" as used herein generally has the same meaning as "and/or". For example, if an embodiment of a component is described as "having at least one among a collar, coupling and connector", it may include only one or more collars, only one or more couplings, only one or more connectors or any combination thereof. Thus, the use of "at least one among" herein and in any appended claims does not require all those possibilities to be available, just any one or more of them.

The terms "for example", "exemplary", "e.g.", "such as" and variations thereof are used herein to provide one or more possible examples of the referenced item, feature, detail, circumstance, etc. that may be present, possible or occur in some instances. Such examples are not exclusive, not the only possibilities and not required for every embodiment or any claims, except and only to the extent as may be expressly specified otherwise herein or in any particular claims hereof and only for such specific references or claims and other claims depending therefrom.

Certain terms are used herein and in the appended claims to refer to particular features and components. As one skilled in the art will appreciate, different persons may refer to a feature or component by different names and this document does not intend to distinguish between components and features that differ in name but not function. The following numerals are used herein for referencing the exemplary features, or components, of various embodiments associated therewith below, but are not intended to and should not limit the scope of this patent or any appended claims, except and only to the extent as may be expressly specified otherwise. These terms, and others used in this patent, are believed to have a sufficiently well-understood and definite meaning to persons of ordinary skill in the relevant art as the name for structure:

10—frac missile skid
10*a*—blender skid
10*b*—end skid
10*c*—middle skid
14—mechanical connector
16—fastener
19—LP side
20—LP line
21—HP side
22—HP line
24—LP inlet
26—blender manifold
28—blender block
29—receiver
30—flange
31—fastener hole
32—spacer spool
33—valve
34—LP outlet
35—valve
36—cap
37—valve actuator
38—spool
38*a*—end spool
39—main bore
40—carrier
41—tee-assembly
42—valve
43—adapter
44—seal
45—gasket
46—adapter spool
48—support surface

48*a*—first support surface
48*b*—second support surface
48*c*—other support surface
50—support structure
52*a*—front of blender block
52*b*—rear of blender block
52*c*—first side of blender block
52*d*—second side of blender block
52*e*—top of blender block
52*f*—bottom of blender block
54—cap
56—frac missile
58—adapter flange
59—spacer spool
60—frac blender
62—expansion/access port
64—HP inlet
66—HP outlet
70—frac pump
72—longitudinal axis of LP line
74—longitudinal axis of HP line
76—hydrocarbon well
80—water source As used throughout and in all parts of this patent, the following terms have the following meanings, except and only to the extent as may be expressly specified otherwise:

The terms "connector", "coupling", "fastener" and the like, and variations thereof, are used interchangeably to mean and include any suitable form of hardware or configuration of components that causes the referenced items to be connected together. The present disclosure and appended claims are thus not limited to the specific types of couplings and connectors described herein or shown in the appended drawings, except and only to the extent as may be expressly specified otherwise herein or in any particular claims hereof and only for such specific references or claims and other claims depending therefrom.

The terms "coupled", "connected", "engaged" and the like, and variations thereof refer to and include either an indirect or direct connection or engagement. Thus, if a first device couples to a second device, that connection may be through a direct connection, or through an indirect connection via other devices and/or connections, except and only to the extent as may be expressly specified otherwise herein or in a particular claim hereof, and only for such reference or claim(s) and any claim(s) depending therefrom.

The terms "elongated" and variations thereof as used herein mean and refer to an item having an overall length (during the intended use of the item) that is greater than its average width.

The terms "fluid" and variations thereof refer to and include one or more liquids, gas and/or solids, including, without limitation, foam, gel, solvent, chemicals, lubricant, materials, particles, proppant, slurry or a combination thereof. The form, components, properties and any other characteristics of any fluid that may be mentioned herein is not limiting upon the present disclosure or appended claims, except and only to the extent as may be expressly specified otherwise herein or in any particular claims hereof and only for such specific references or claims and other claims depending therefrom.

The terms "high-pressure", "HP", "discharge" and variations thereof are used interchangeably herein to refer generally to use in connection with the discharge or high pressure side of a hydraulic fracturing missile or system, which may, for example, accommmodate fluid or slurry flow at pressures of up to approximately 15,000-20,000 psi (or more or less), but which pressure may vary depending upon the type of equipment, application, environment or circumstances of use, other variables or a combination thereof. The present disclosure and appended claims should not be limited by this definition or any other meaning of high pressure or any actual amount or ranges of pressure, except and only to the extent as may be expressly specified otherwise herein or in any particular claims hereof and only for such specific references or claims and other claims depending therefrom.

The terms "low-pressure", "LP", "suction" and variations thereof are used interchangeably herein to refer generally to use in connection with the suction or low pressure side of a hydraulic fracturing missile or system, which may, for example, accommodate fluid or slurry flow at pressures of no more than approximately 285-1,000 psi (or more or less), but which pressure may vary depending upon the type of equipment, application, environment or circumstances of use, other variables or a combination thereof. The present disclosure and appended claims should not be limited by this definition or any other meaning of low pressure or any actual amount or ranges of pressure, except and only to the extent as may be expressly specified otherwise herein or in any particular claims hereof and only for such specific references or claims and other claims depending therefrom.

The terms "minimal" and variations thereof generally mean no more than 5-10%.

The terms "party", "user", "entity", "person", "operator", "manpower", "labor" and the like refer to and include one or more humans, legal entities, virtual entities, beings and avatars, robots and robotic components, artificial intelligence-driven components/circuitry, other entities, components and the like or the effort thereof.

The terms "rigidly coupled" and variations thereof mean connected together in a manner that is intended not to allow any, or more than an insubstantial, tolerable, nominal or minimal amount of relative movement therebetween as may be expected during typical or normal operations. In other words, if components A and B are rigidly coupled together, they are not movable relative to one another (more than an insubstantial, tolerable, nominal or minimal amount) during typical or expected operations.

The terms "spool" and variations thereof refer to a section of a conduit (e.g., pipe, tube) designed for and capable of use in an LP or HP line of a hydraulic fracturing manifold or related component. A spool need not be flanged or hubbed, even though various embodiments herein include flanges or hubs.

The terms "substantial" and variations will depend upon the type of component, equipment, application, circumstances of use, other variables or a combination thereof, as are and become further known to persons of ordinary skill in the relevant art. In some instances, such as when used to describe the amount or degree of something (e.g., "reduces a substantial volume of fluid"), substantial may mean by at least approximately 75% and insubstantial being no more than about 25%.

The terms "universal", "modular" and variations thereof are used interchangeably herein to refer generally to a component or item having a standard construction or standardized units, features or dimensions for ease, flexibility and versatility in its use, interchangeability, replacement, positioning, interconnection, deployment, removal, any other purposes or a combination thereof. Multiple of the same type, model or version of universal or modular component may be identical and interchangeable and, in some cases, reversible or non-direction-specific (e.g., to allow fluid flow therethrough in either direction). A universal or modular component may be a stand-alone item designed to be easily removed and replaced (e.g., with mechanical connectors), useful at different locations in a component or assembly (e.g., frac missile, missile skid, LP line, HP line), reversible or non-direction-specific (e.g., to allow fluid flow therethrough in either direction) or a combination thereof.

It should be noted that any of the above terms may be further explained, defined, expanded or limited below or in other parts of this disclosure. Further, the above list of terms is not all inclusive and other terms may be defined, used or explained below or in other sections of this patent.

Figure 2:
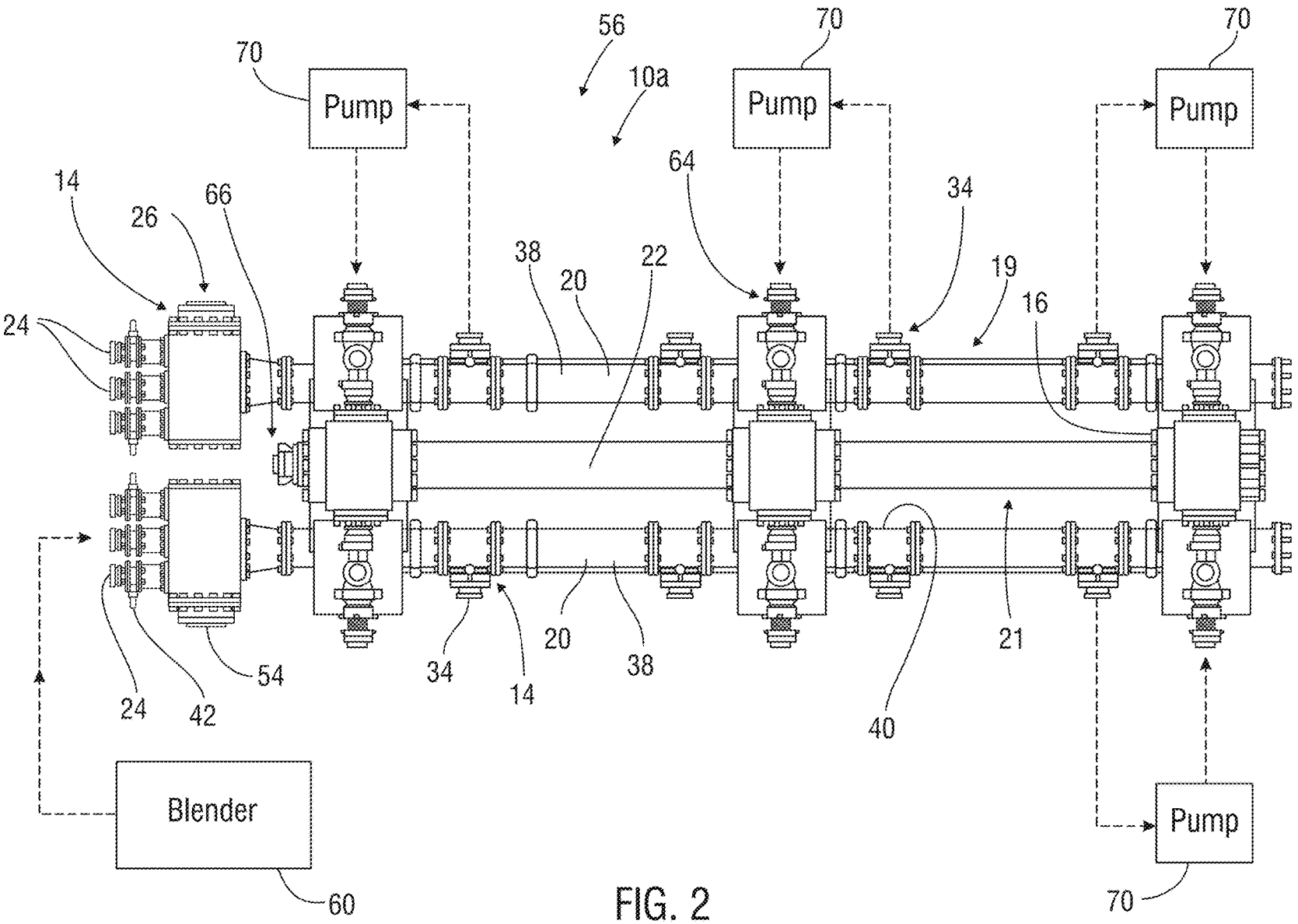
FIG. 2 is a top view of the exemplary frac missile skid of FIG. 1 shown coupled to numerous frac pumps in accordance with one or more embodiments of the present disclosure.

Referring initially to FIGS. 1 & 2, a frac missile skid 10 useful to form, or be part of, a frac missile 56 in accordance with one or more embodiments of the present disclosure is shown. The exemplary missile skid 10 includes a suction, or low-pressure, side 19 and a discharge, or high-pressure, side 21 mounted to and/or carried upon a support structure 50 (e.g., skid, framework, platform, trailer, etc.). The illustrated LP side 19 includes at least one elongated suction or LP line, or conduit, 20 and the HP side 21 includes at least one elongated discharge or HP line, or conduit, 22. For example, two LP lines 20 and one HP line 22 are shown disposed on the support structure 50, but the missile skid 10 could have fewer or more LP lines 20 (e.g., 0, 1, 3, 4, etc.) and HP lines 22 (e.g., 0, 2, 3, 4, etc.).

The exemplary LP line(s) 20 and HP line(s) 22 could be arranged in, or on, the missile skid 10 in any suitable manner. Each illustrated LP line 20 and HP line 22 is shown extending generally longitudinally on the support structure 50 and can thus be characterized as having a respective longitudinal axis 72, 74 (e.g., FIG. 11) extending therethrough. In this example, the two LP lines 20 are shown in spaced parallel relationship with each other and offset to the left and right, respectively, below the HP line 22 on the skid 10, but could be arranged in any other configuration. For example, a first LP line 20 could be above a second LP line 20 and the HP line 22 spaced-apart from them at the height of either LP line 20 or elsewhere. Thus, the present disclosure is not limited by the configuration, quantity or physical arrangement of the LP and HP lines 20, 22 in, or on, the missile skid 10, except and only to the extent as may be expressly specified otherwise herein or in a particular appended claim and only for such claim(s) and potentially one or more claims depending therefrom.

Figure 3:
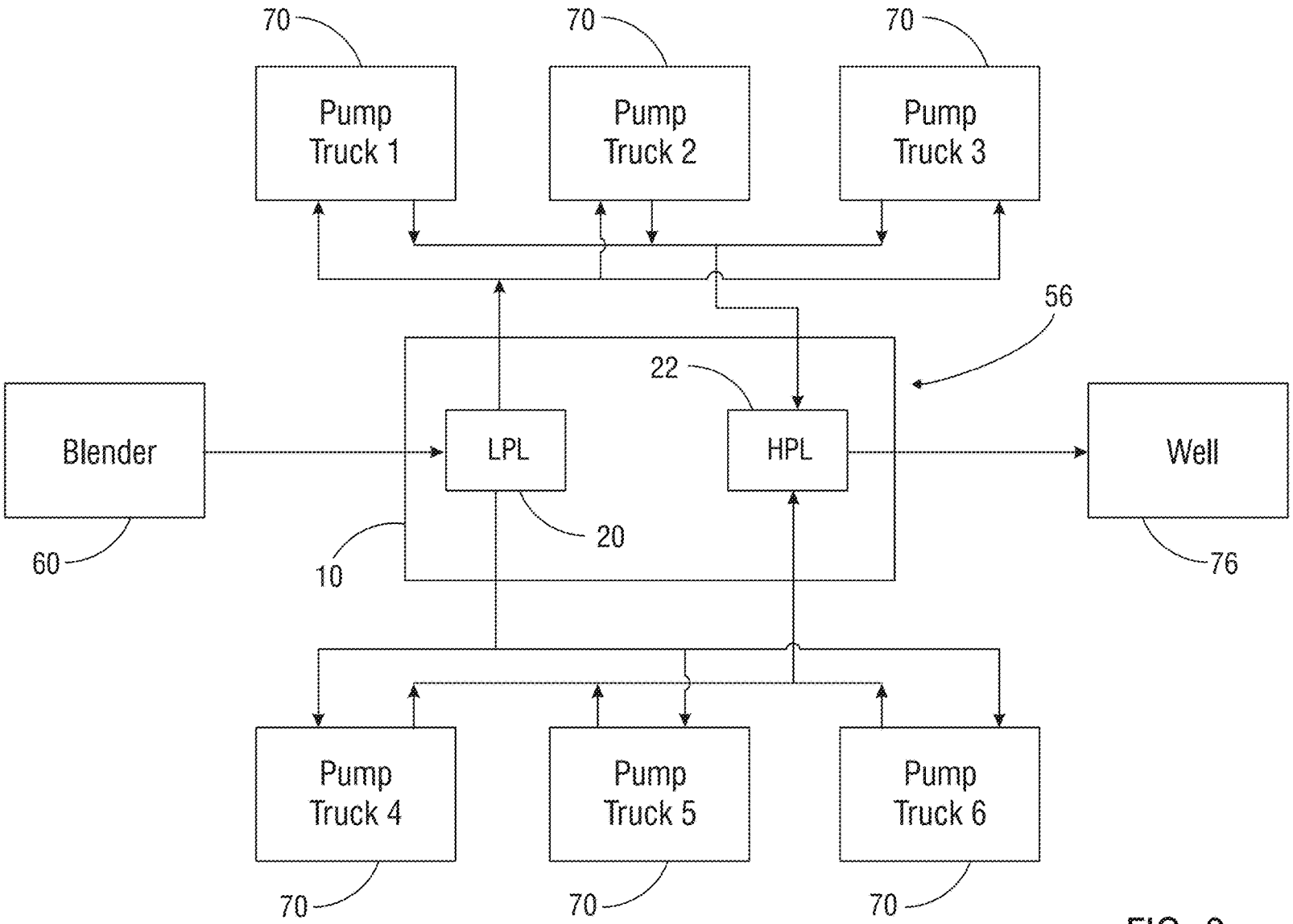
FIG. 3 is a block diagram showing deployment of an exemplary frac missile in accordance with one or more embodiments of the present disclosure.

The LP and HP lines 20, 22 may have any suitable purpose(s). For example, one or more LP lines 20 may be used to fluidly connect one or more frac blenders 60 with one or more frac pumps 70 (e.g., on pump trucks or trailers), while the HP line(s) 22 may be used to fluidly couple the frac pump(s) 70 with one or more hydrocarbon wells 76 (or related components). In many applications, the frac pumps 70 may suck, or draw in fluid (e.g., frac-slurry with proppant, water, chemicals, etc.) from the frac blender 60 through one or more exemplary LP lines 20, then pump the slurry at a higher pressure through one or more HP lines 22 to the well(s) 76. This exemplary sequence is shown in FIG. 3. However, the present disclosure is not limited to this sequence, arrangement or use of the LP and HP lines 20, 22. Thus, the uses of the LP and HP lines 20, 22 on the missile skid 10 are not limiting upon the present disclosure, except and only to the extent as may be expressly specified otherwise herein or in a particular appended claim and only for such claim(s) and potentially one or more claims depending therefrom.

Referring again to FIGS. 1 & 2, the LP and HP lines 20, 22 may have any suitable form, configuration, components, construction and operation. For example, the LP line 20 may include one or more LP inlets 24 useful for fluidly coupling the LP line 20 to one or more frac blenders 60 (and/or other equipment, such as a water source) and one or more LP outlets 34 for fluidly coupling the LP line 20 to one or more frac pumps 70 and/or other equipment. The illustrated missile skid 10 shows a total of twelve LP inlets 24 (e.g., FIG. 7) for connection to one or more frac blenders 60 and/or other equipment (e.g., water source) and three LP outlets 34 on each side for connection with up to six frac pumps 70 and/or other equipment. An exemplary fourth spare LP outlet 34 is also shown on each side for redundancy or backup (e.g., upon failure of an LP outlet 34, related valve 35 or other part).

The exemplary HP line 22 includes one or more (e.g., six) HP inlets 64 for fluidly coupling the frac pump(s) 70 (or other equipment) to the HP line 22, along with one or more HP outlets 66 useful for fluidly coupling the HP line 22 to the well(s) 76 and/or other or component(s). It should be noted, however, the above number and type of inlets 24, 64 and outlets 34, 66 are provided for illustrative purposes only. In practice, for example, the actual quantity and type of inlets 24, 64 and outlets 34, 66, when included, may vary depending upon the needs at a particular job and/or other variables. Thus, the present disclosure is not limited to the above type, quantity, configuration and function of inlets 24, 64 and outlets 34, 66, except and only to the extent as may be expressly specified otherwise herein or in a particular appended claim and only for such claim(s) and potentially one or more claims depending therefrom.

Still referring to FIGS. 1 & 2, in preferred embodiments, the missile skid 10, or the LP and/or HP, lines 20, 22 may be made up of numerous components formed, connectable together and disconnectable without any welds or welding. In other embodiments, at least those components of the missile skid 10 or LP and/or HP lines 20, 22 that have surfaces, orifices or passageways exposed to frac fluid flowing therethrough are formed and connectable/disconnectable with one another or other components without welds or welding. In many situations, some of the auxiliary or ancillary components (e.g., hoses) used with the missile skid(s) 10 or missile 56 may involve the use of welds. In some embodiments, a minimal number of welds or welding may be used in forming, connecting or disconnecting components of the missile skid 10 or the LP and/or HP lines 20, 22. In yet other embodiments, components of the missile skid 10 or the LP and/or HP lines 20, 22 may be formed, connectable together and/or disconnectable without a substantial number of welds or substantial need for welding. In yet other embodiments, there may be a need or desire for an even greater number and/or occurrence of welds used in forming, connecting or disconnecting such components.

Components and connections without welds may last longer than if welded, have a greater useful lifespan and obviate the need to obtain welding permits or inspect job sites (e.g., to clear out gas and other ignitable sources), be more quickly and easily assembled, modified, disassembled, repaired and reconfigured, reduce down time, manpower needs, potential safety hazards, maintenance and repair efforts, have other benefits or a combination thereof. For example, the LP line 20 and/or HP line 22 may include at least one respective elongated spool 38 having a main bore 39 (e.g., FIG. 4) extending longitudinally therethrough (e.g., along or in the longitudinal axis 72, 74 of the respective LP and/or HP line 20, 22, FIG. 11), and which is releasably connectable and disconnectable with one or more other spools 38 and/or other components without welding. This may be done in any suitable manner. For example, one or more mechanical connectors 14 may be used to releasably mechanically couple each spool 38 to one or more other spools 38 and/or other components (e.g., carriers 40, caps 36, blender manifolds 26, FIG. 4) without welding. When mechanically coupled together, the main bores 39 of the exemplary spools 38 are typically longitudinally aligned and fluidly coupled. However, although not preferred, other embodiments may include welding to make up or connect some of the components of the LP and/or HP lines 20, 22.

Figure 4:
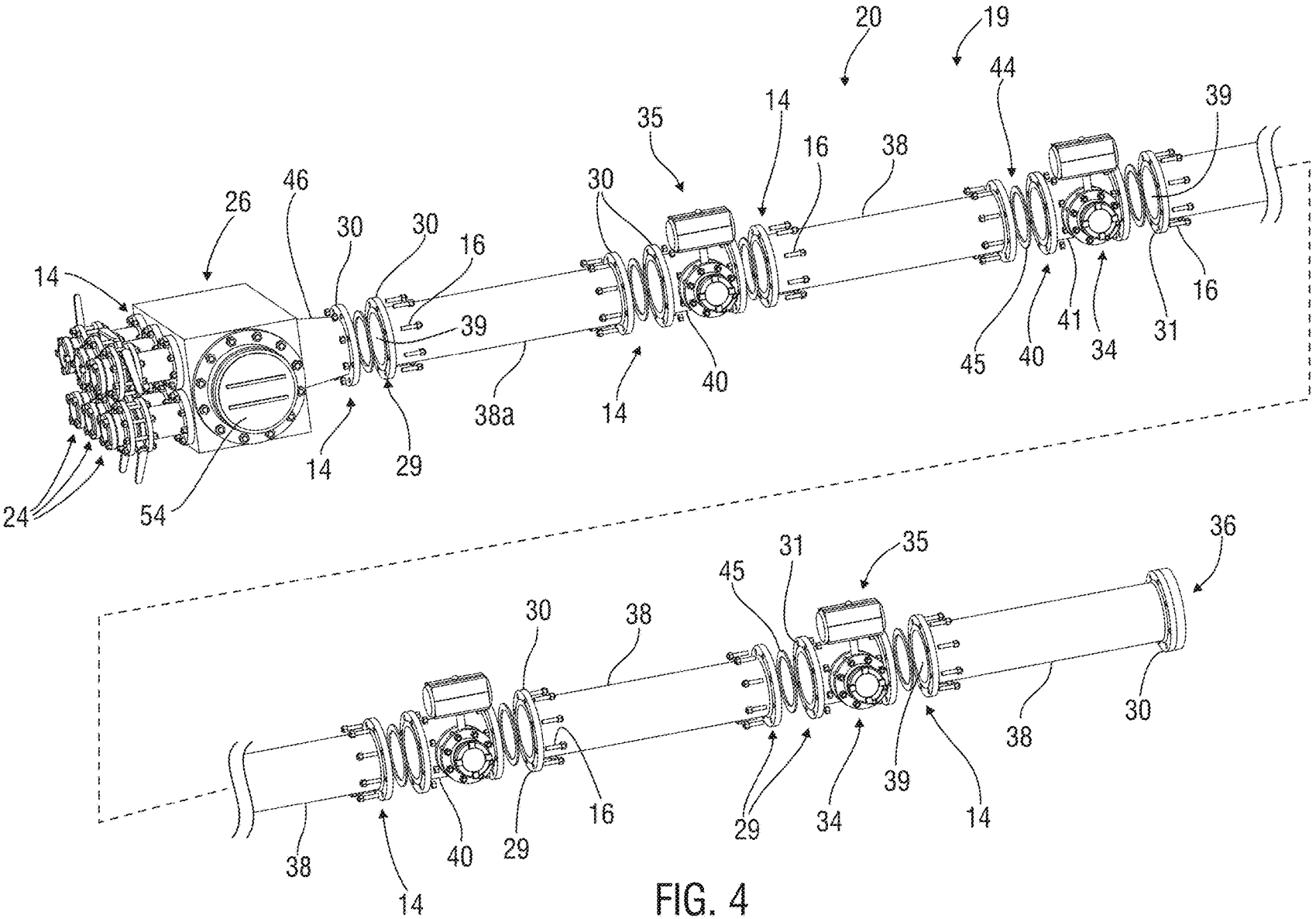
FIG. 4 is an exploded view of an exemplary LP line of the frac missile skid shown in FIG. 1 in accordance with one or more embodiments of the present disclosure.

Referring now to FIG. 4, the exemplary mechanical connectors 14, when included, may have any suitable form, configuration, components and operation, so long as they can be used to assist in effectively releasably coupling multiple components of an LP line 20 or a HP line 22. For example, the mechanical connector 14 may involve mateable threads on, or associated with, the respective components that are coupled together. For another example, the mechanical connector 14 may include one or more fasteners 16 useful for interconnecting, or engaging, receivers 29 on adjacent spools 38 (and/or other components, such as one or more carriers 40, caps 36, blender manifolds 26, etc.). The fasteners 16 and receivers 29, when included, may likewise have any suitable form, configuration, components, construction and operation. For non-limiting examples, the fasteners 16 may include one or more pins, screws, bolts, locks, bars, straps, mating members and/or the like and be removable, releasable or openable. The receivers 29 may, for example, include corresponding clamp members, hub connectors, mating members or fastener holes, slots or the like formed in the component (e.g., spool 38, blender manifold 26, carrier 40) or a related component.

In the present embodiment, the fasteners 16 are bolts and the receivers 29 are flanges 30 having one or more fastener holes 31 formed therein and provided on each spool 38 and/or other component (e.g., blender block 28, carrier 40, etc.). The illustrated receivers 29 (e.g., flanges 30) are integrally formed as part of the component (e.g., spool 38, blender block 28, carrier 40) without welding, such as through forging (or molding, casting, machining or other processes) or may be mechanically coupled thereto (e.g., bolted, pinned, threadably or otherwise mateably-connected). In other embodiments, though not preferred, welding may also or instead be used to couple one or more of the receivers 29 with its corresponding component (e.g., spool 38, blender block 28, carrier 40). The illustrated flange 30 extends radially-outwardly from the respective component (e.g., spool 38, blender block 28, carrier 40), but could instead extend radially inwardly, be flush with the respective component or configured in any other manner. Further, the receivers 29 may be provided at, or coupled to, any location on the spool 38 and/or other components, such as, for example, at, proximate to or spaced from one or both ends thereof or at one or more locations therebetween.

However, the fasteners 16 and receivers 29 may take any other suitable form. For example, receivers 29 may engage or mate with one another without the use of fasteners 16 or fastener holes 31, such as via threadable engagement, or be integrally formed together. Likewise, the mechanical connector 14 may take any other form and not include fasteners 16 and/or receivers 29. Accordingly, any suitable type and arrangement of mechanical connectors 14 may be used at any locations on the LP and/or HP lines 20, 22 to couple components together (e.g., without welding), such as, without limitation, clips, Chinese-finger-like portions, push-to-connect fittings (e.g., SharkBite™ fittings), hubbed connections, snaps, ratchet or gripping portions, clamps, hammer-union connections, threaded or otherwise mateable flanges, sleeves or other portions or a combination thereof. Thus, the present disclosure is not limited to the above form, configuration and operation of mechanical connectors 14, except and only to the extent as may be expressly specified otherwise herein or in a particular appended claim and only for such claim(s) and potentially one or more claims depending therefrom. Further, other forms of connecting components and/or welds (not preferred) may be used in addition to or instead of the mechanical connectors 14 to make up various components of the LP and/or HP lines 20, 22, or each LP line 20 and/or HP line 22 may be formed of a single integral respective component.

Still referring to FIG. 4, one or more seals 44 may be provided between any desired components in the respective LP and/or HP lines 20, 22 or other locations. In the present embodiment, a single seal 44 is disposed at least between each pair of adjacent components interconnected in the respective longitudinal axis 72, 74 (FIG. 11) of the LP and HP lines 20, 22. For example, a seal 44 may be provided between each adjacent spool 38 and carrier 40 and, in the case of the LP line 20, between each end spool **38*a* and blender manifold 26 (or any intermediate components, such as the adapter spool 46). When included, the seal 44 may have any suitable form, configuration, components and operation sufficient to provide the desired sealing. In some embodiments, the seals 44 may include one or more gaskets 45, such as the presently commercially available, appropriately pressure-rated Garlock® metallic gaskets (see e.g., https://www.fluidsealingproducts.com/pdf/garlock-gasket-s.pdf). Some applications may warrant the use of different versions or types of seals 44 at different locations (e.g., different pressure-ratings for the LP and HP lines 20, 22). However, other embodiments may include a different number, location and type of seal 44, seals 44** that are integral with, or coupled to, one or more components, or no seals.

Figure 5:
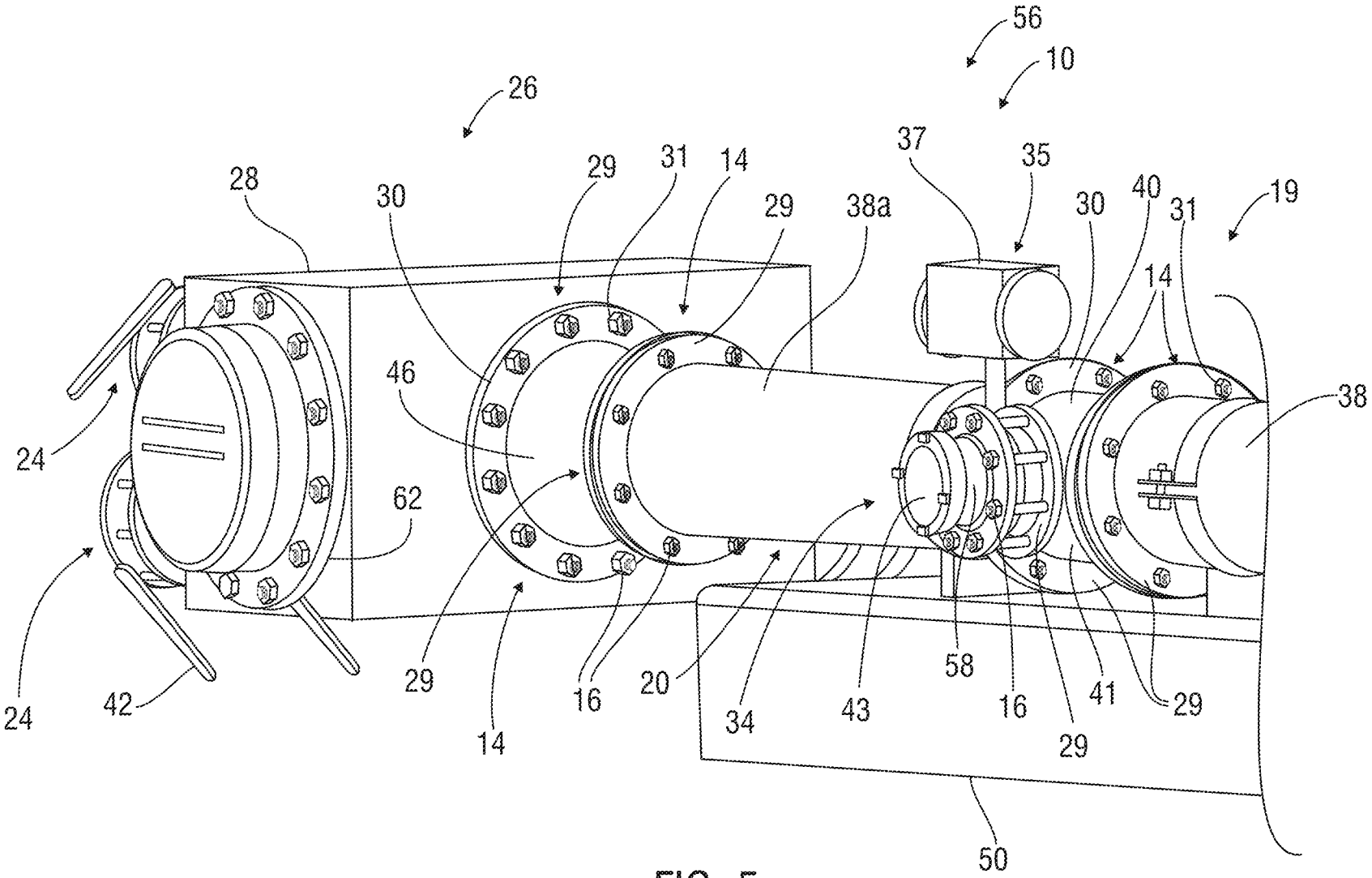
FIG. 5 is a perspective view of part of the exemplary LP line shown in FIG. 4 in accordance with one or more embodiments of the present disclosure.
Figure 6:
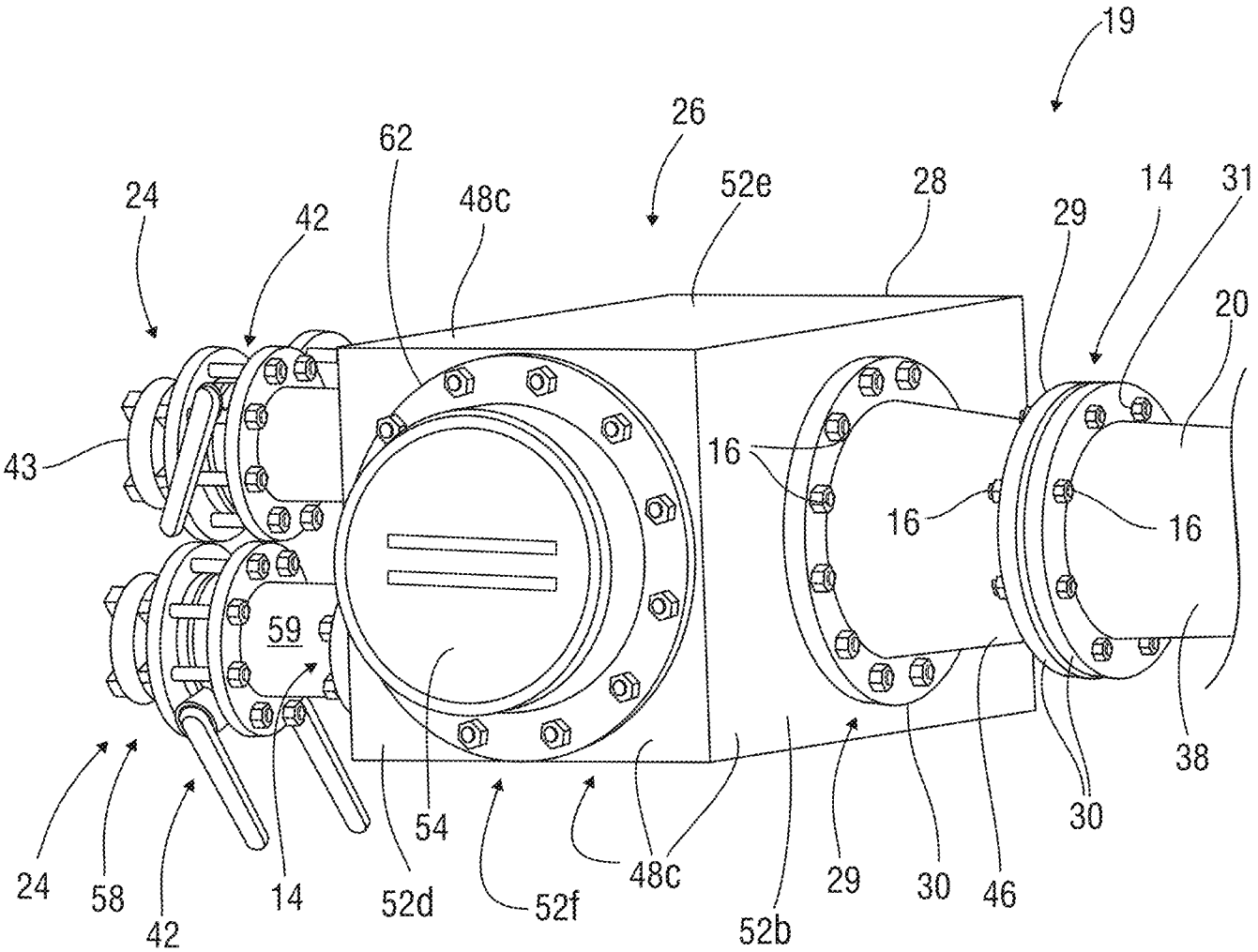
FIG. 6 is a perspective view of part of the exemplary LP line shown in FIG. 5 in accordance with one or more embodiments of the present disclosure.

Now referring to FIGS. 4-6, in another independent aspect of the present disclosure, one or more LP inlets 24 may be provided in or on, or associated with, one or more LP lines 20 in any suitable manner. For example, one or more LP inlets 24 may be integrally formed as part of one or more spools 38 (or other components) of an LP line 20 or be engageable therewith. In the present embodiment, the LP inlets 24 are provided in, or on, one or more low pressure, or blender, manifolds 26 releasably mechanically and fluidly engageable with one or more (e.g., end) spools 38 of one or more LP lines 20 without welding. The blender manifold 26 may, for example, be coupled to one or more LP lines 20 with one or more mechanical connectors 14. In the present embodiment, the blender manifold 26 includes one or more receivers 29 (e.g., integrally formed flanges 30) releasably mechanically engageable with an end spool **38*a* of at least one LP line 20 with one or more fasteners 16. Of course, any other form of mechanical connectors 14, such as described above, may be associated with the exemplary blender manifold 26 for coupling it to one or more LP lines 20 or other components. Further, in some embodiments, the blender manifold 26 may be integrally formed as part of the LP line(s) 20 or a component thereof (e.g., spool 38) or welded thereto. Moreover, the LP inlet(s) 24 may be provided in or on the LP line 20 in any other manner (e.g., without a blender manifold 26**).

Figure 7:
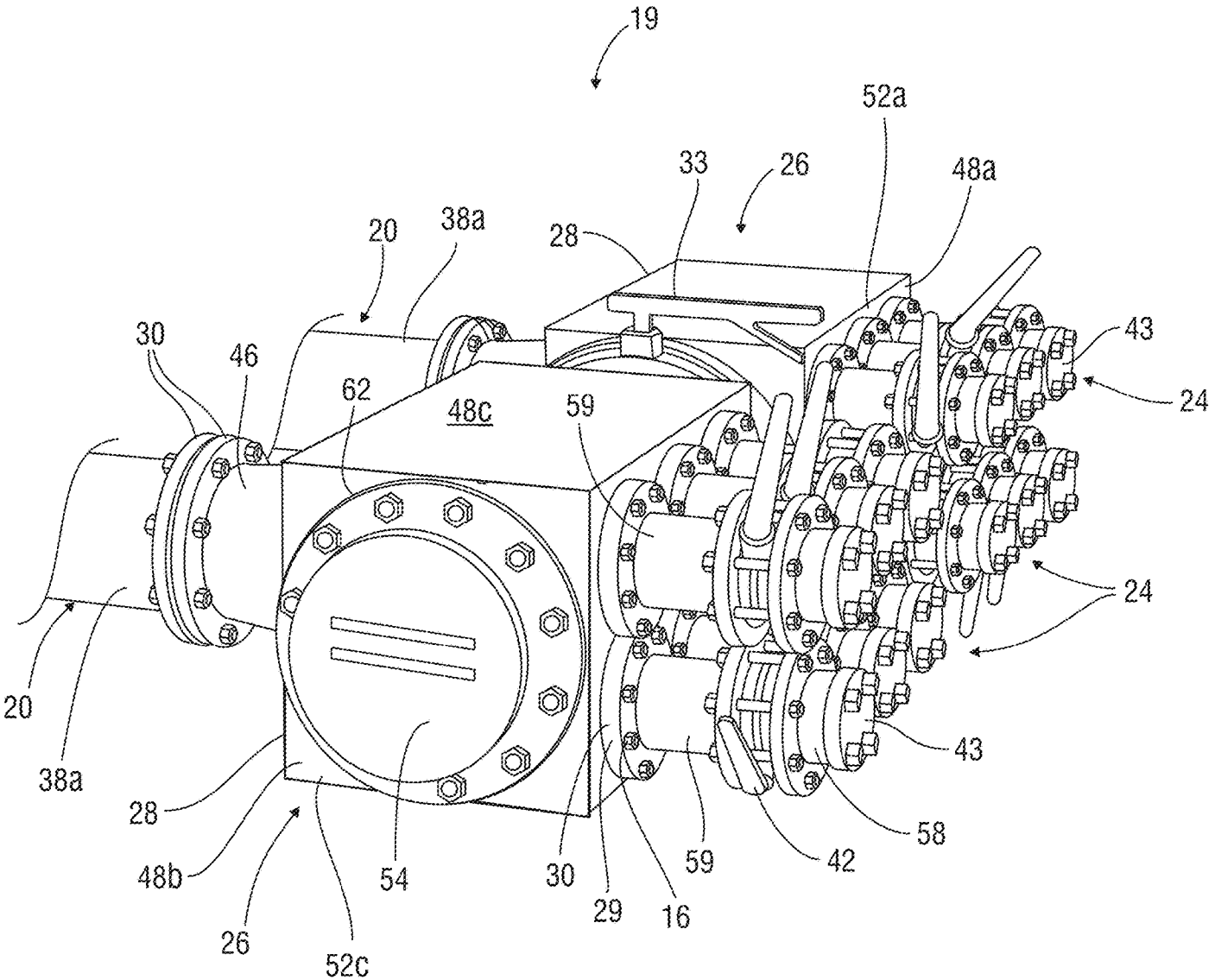
FIG. 7 is a perspective view of part of an exemplary frac missile skid having a pair of fluidly coupled blender manifolds with an exemplary valve therebetween in accordance with one or more embodiments of the present disclosure.

Referring briefly to FIG. 7, if desired, the exemplary LP line 20 may be configured so that the LP inlets 24 may be easily removed and repaired, modified, switched out or replaced (e.g., without welding), such as to due to damage thereto, to match the diameter of one or more hoses, pipes, couplings or other components connecting the frac blender 60 (e.g., FIG. 1) or other component (e.g., water source 80, FIG. 12) and/or for any other purposes. In fact, in some embodiments, different sized LP inlets 24 may be provided in the same LP line 20.

This may be accomplished in any suitable manner. For example, the LP inlet 24 may include at least one (e.g., hammer union) adapter 43 or other component releasably mechanically engageable with the blender manifold 26. In the present embodiment, the adapter 43 is releasably mechanically coupled to an adapter flange 58 that releasably mechanically engages a spacer spool 59, which releasably mechanically engages a receiver 29 (e.g., flange 30) integrally formed into (or mechanically connected to) the blender manifold 26.

In other embodiments, the LP inlet 24 may be releasably coupled to the blender manifold 26 (or other component) with any other form of connector (e.g., pins, clips, Chinese-finger-like portions, push-to-connect fittings (e.g., SharkBite™ fittings), snaps, ratchet or gripping portions, clamps, hubbed connections, threaded or otherwise mateable flanges, sleeves or other portions), and/or with the use of welds, or may instead be integral therewith or otherwise not removable therefrom. In the illustrated embodiment, a valve 42 (e.g., butterfly valve assembly) is shown associated with the LP inlet 24, but the LP inlet 24 may have any other parts. Thus, the present disclosure is not limited to this arrangement of exemplary components and parts associated with the LP inlet 24, except and only to the extent as may be expressly specified otherwise herein or in a particular appended claim and only for such claim(s) and potentially one or more claims depending therefrom.

Referring now to FIGS. 6 & 7, when included, the low pressure, or blender, manifold 26 may have any suitable form, configuration, components, construction and operation. In the present embodiment, the blender manifold 26 includes at least one blender block 28 configured to be coupled to one or more LP lines 20 and capable of carrying a desired quantity of LP inlets 24. For example, the blender block 28 may be releasably fluidly and mechanically engageable with the LP line 20 (e.g., end spool 38*a*) or another component without the use of welds, such as via one or more mechanical connectors 14 (e.g., as described above), either directly, or via one or more other (intermediate) components. In the illustrated embodiment, an adapter spool 46 is used to releasably couple the blender block 28 to one or more LP lines 20. However, the blender block 28 or intermediate component(s) may instead be welded to one or more LP lines 20, integral therewith or coupled thereto with any other arrangement of parts.

The adapter spool 46, when included, may have any suitable form, configuration, components, construction and operation. The exemplary adapter spool 46 extends from the rear 52*b* of the blender block 28 and is releasably mechanically and fluidly engageable therewith, such as to easily switch out the adapter spool 46 to match the particular size (e.g., diameter) of the corresponding spool(s) 38 (or other component) of the LP line 20, for repair or replacement, to provide access into the blender block 28 for inspection, maintenance or the like and/or for any other purposes. In the present embodiment, mechanical connectors 14 may be used. For example, each end of the adapter spool 46 may include a receiver 29 (e.g., flange 30) or any other suitable feature or components for releasable mechanical engagement without welds to the blender block 28 at one end and an end spool 38*a* (or other component) of the LP line 20 at the opposite end. If desired, the illustrated receivers 29 of the adapter spool 46 may be integrally formed therein or thereon without welding, such as through forging (or molding, casting, machining, etc.) or may be mechanically coupled (e.g., with bolts) thereto or with welds. In other embodiments, the adapter spool 46 may be integral with or welded to the blender block 28 or spool 38, or not included. Moreover, the blender manifold 26 (e.g., blender block 28) may be engageable with, or coupled to, one or more LP lines 20 in any other manner.

Still referring to FIGS. 6 & 7, in another independent aspect of the present disclosure, the exemplary blender manifold 26 may be formed with, or provide, at least one support surface 48 capable of hosting or carrying one or more LP inlets 24 and/or have any other purposes. In some embodiments, the support surface(s) 48 may provide maximum or optimal surface area to accommodate many (e.g., 6 or more) LP inlets 24 and/or provide flexibility and ease in quickly adding and removing LP inlets 24 as desired. In fact, in some instances, different sized LP inlets 24 may be provided on different support surfaces 48.

When included, the support surface(s) 48 may be provided in any suitable manner. For example, the illustrated blender block 28 may have an at least substantially rectangular shape (e.g., as shown) for providing maximum real estate in the form of one or more flat support surfaces 48. In the present embodiment, the blender block 28 includes a first support surface 48*a* at its front 52*a* configured to host the principal LP inlets 24 for the LP line 20 and a second support surface 48*b* at a first side 52*c* thereof to host additional LP inlets 24. If desired, one or more other support surfaces 48*c* could instead or also be provided at a second side 52*d*, the rear 52*b*, top 52*e* or bottom 52*f* of the blender block 28, on other part of the blender manifold 26, or a combination thereof. Likewise, any of the support surfaces 48 could host the principal and/or additional LP inlets 24 and/or have any other purposes. Moreover, when included, the blender block 28 may have any other shape (square, pentagonal, hexagonal, etc.) and configuration, and the support surfaces 48 may have any other shape (e.g., curved, stepped, angled) and location.

Still referring to FIGS. 6 & 7, when included, the support surface(s) 48 may have any suitable form, configuration, components and operation. In these embodiments, one or more support surfaces 48 may include an expansion/access port 62, or other feature, where a blender block expander (not shown) that carries a desired number of LP inlets 24 and/or any other components may be releasably coupled (e.g., with fasteners 16) and/or to serve any other purpose(s). For example, the expansion/access port 62 may be used to provide access into the blender block 28, such as for inspection, cleaning, repair, maintenance, etc. If desired, a door, or cover, having any suitable form, configuration, components and operation may be provided over the expansion/access port 62. In FIG. 6, a releasable cap, or blanking flange, 54 is shown mechanically coupled to the exemplary expansion/access port 62 of the second support surface 48*b*. The exemplary cap 54 may be selectively opened and/or removed for connection thereto of a blender block expander or other component(s) and/or for any other purposes. In FIG. 7, a releasable cap 54 is mechanically coupled to an expansion/access port 62 on the support surface 48*c* at the second side 52*d* of the exemplary blender block 28. Accordingly, any number of support surfaces 48 may include one or more expansion/access ports 62 (or other features) at any desired location, with any desired function and operation.

In another independent aspect of the present disclosure, in various embodiments, the frac missile 56 or missile skid 10 may include one or more LP lines 20 and one or more blender manifolds 26. For example, multiple LP lines 20 may be coupled to a single blender block 28, such as at different respective sides/ends 52*a-f* of the blender block 28. For another example, one or more LP lines 20 may be indirectly coupled to a single blender block 28, such as through the use of one or more flow connectors or loops (not shown) fluidly connecting the LP lines 20 together. In such instance, if desired, one or more valves may be included to selectively control the flow of fluid as between the LP lines 20 or fluidly isolate them.

Figure 10:
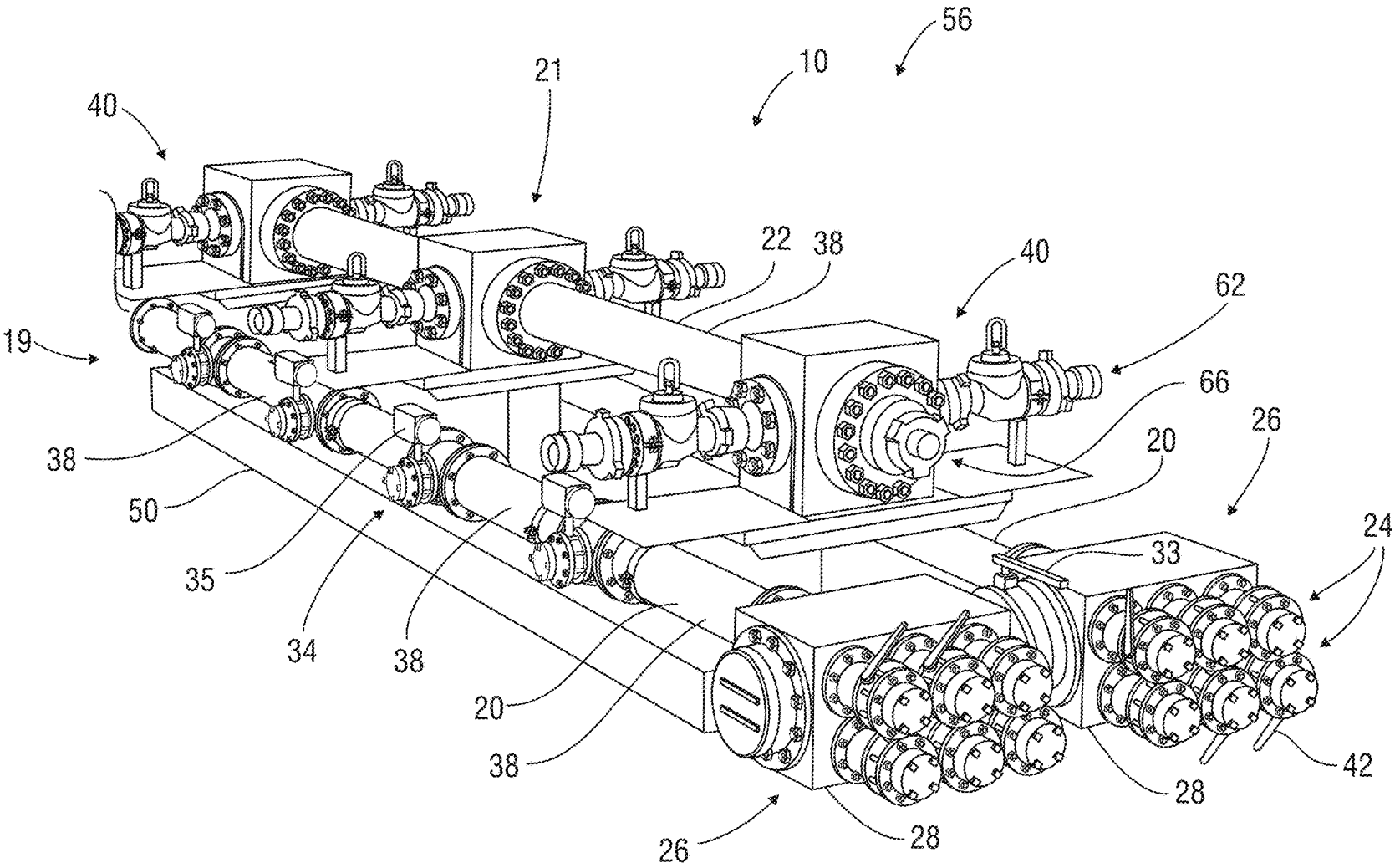
FIG. 10 is a perspective view of an exemplary frac missile skid having a pair of fluidly coupled blender manifolds with an exemplary valve therebetween in accordance with one or more embodiments of the present disclosure.

For yet another example, such as shown in FIGS. 2 & 10, separate blender manifolds 26 may be directly coupled to separate respective LP lines 20. In such instances, the blender manifolds 26 and/or the LP lines 20 may be configured to be fluidly connected, connectable or isolated from one another. If desired, the exemplary LP lines 20 can be configured to provide for split-stream flow or slurry-only mix, such as with a two-piece blender manifold 26 design without the need for a valve. In FIG. 2, for example, neither the blender manifolds 26 nor the LP lines 20 are fluidly coupled together and are thus fluidly isolated.

Figure 8:
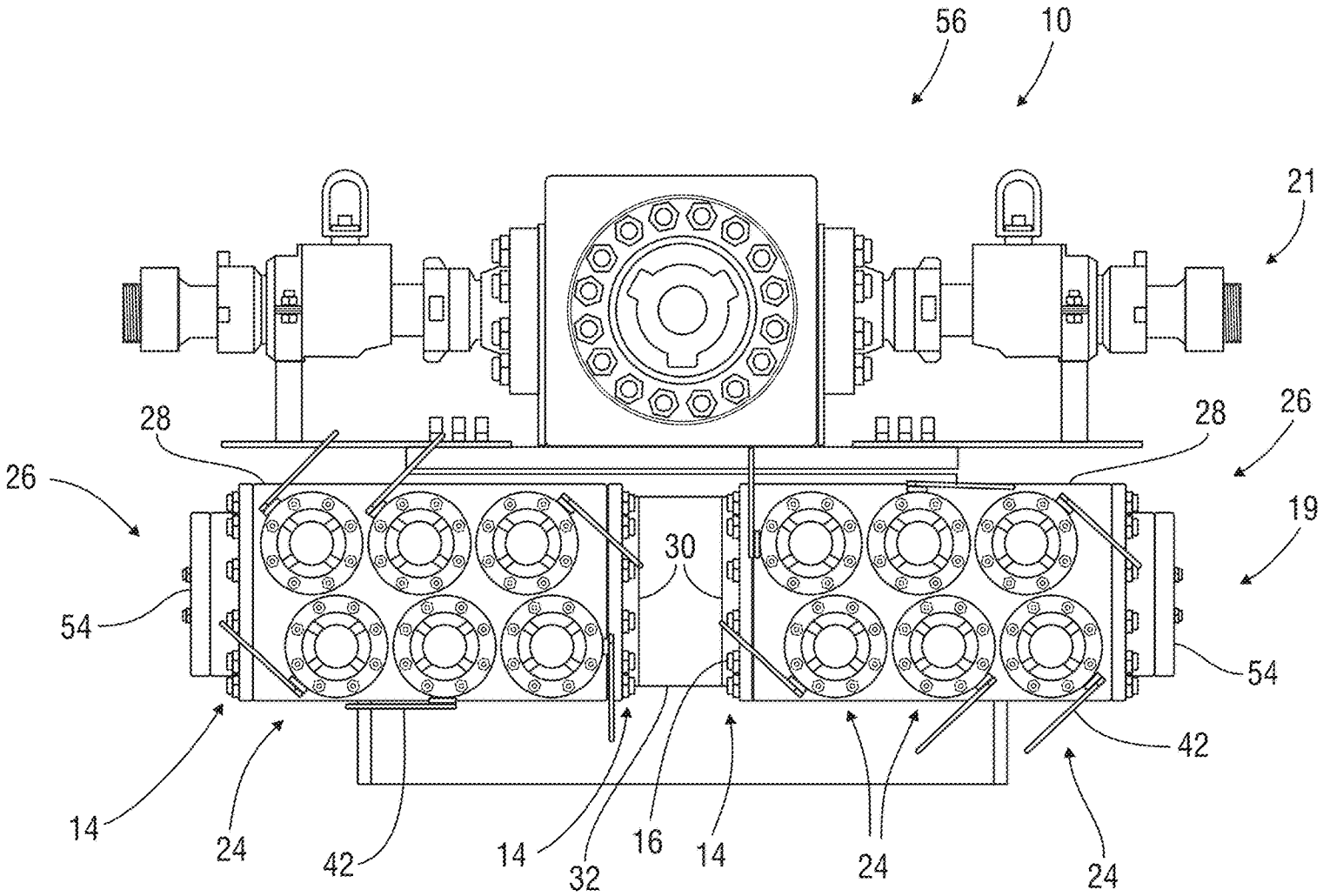
FIG. 8 is an end view of an exemplary frac missile skid having a pair of fluidly coupled blender manifolds in accordance with one or more embodiments of the present disclosure.

For another example, the blender manifolds 26 may themselves be fluidly coupled together, such as via one or more connectors or other components extending therebetween, integral formation or welding. In FIG. 8, an exemplary spacer spool 32 is shown engaged between and fluidly coupling the illustrated blender blocks 28. If desired, the spacer spool 32 may be releasably mechanically and fluidly engageable with the exemplary blender blocks 28 with mechanical connectors 14, such as described above or in any other suitable manner. For example, the mechanical connectors 14 may include one or more fasteners 16 releasably coupled between receivers 29 (e.g., flanges 30) on the spacer spool 32 and the blender blocks 28. If desired, the receivers 29 (e.g., flanges 30) may be integrally formed into or onto the spacer spool 32 and/or blender block(es) 28 without welding, such as through forging (or molding, casting, machining or other processes). In other embodiments, the spacer spool 32 may be integral with, or welded to, one or more blender blocks 28 or coupled thereto or associated therewith in any other manner.

Figure 9:
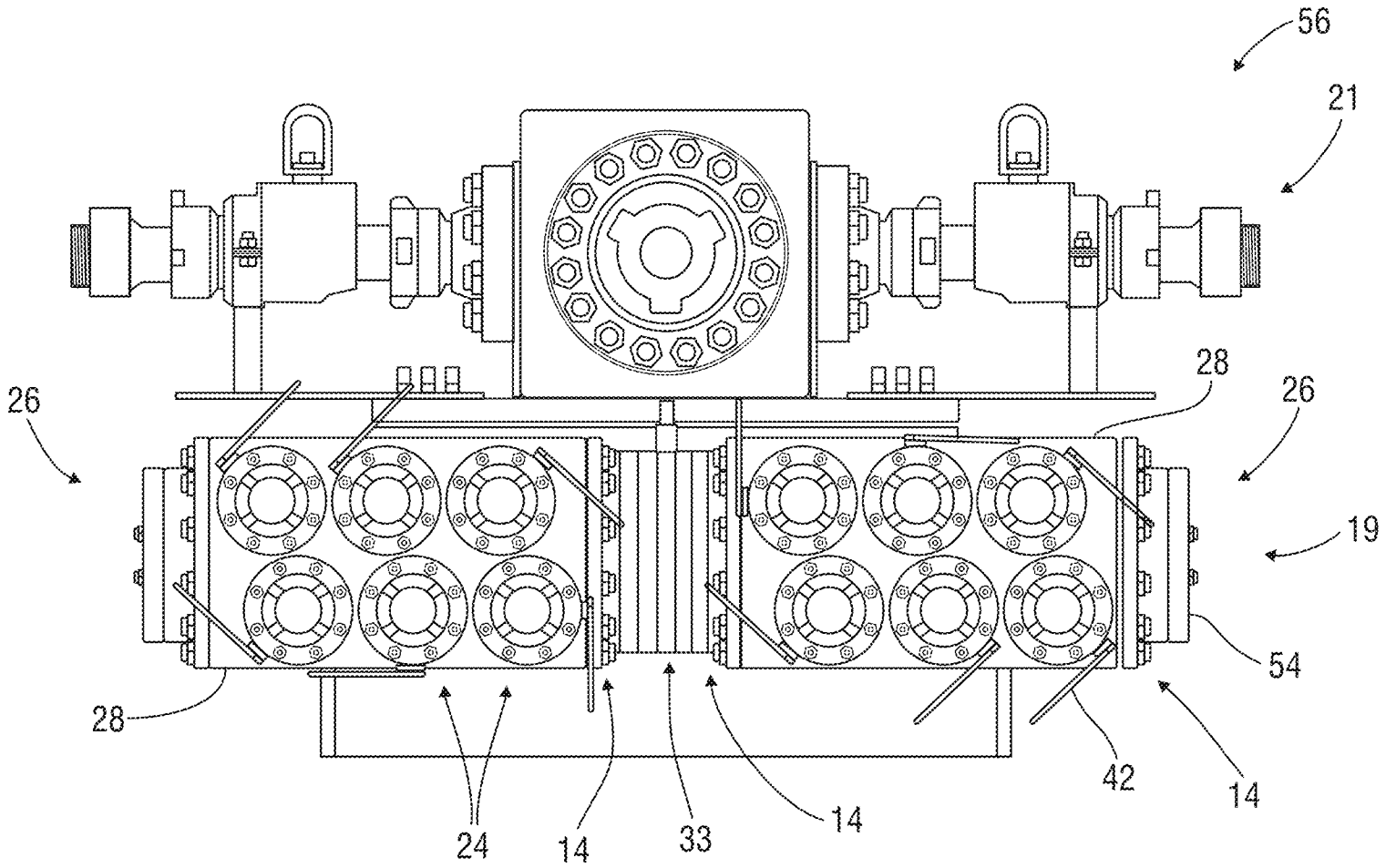
FIG. 9 is an end view of an exemplary frac missile skid having a pair of fluidly coupled blender manifolds with an exemplary valve therebetween in accordance with one or more embodiments of the present disclosure.

For yet a further example, multiple blender manifolds 26 may be selectively fluidly coupled together. This may be accomplished in any suitable manner. Referring to FIGS. 9 & 10, for example, one or more valves, removable blind, or pancake-style, flanges or the like may be employed between the blender manifolds 26 to selectively switch between fluidly coupled and fluidly isolated. In the illustrated embodiment, a selectively controllable valve 33 (e.g., 12" butterfly valve) is shown fluidly coupled between the blender blocks 28 to allow and disallow fluid flow therebetween. For other examples, the LP lines 20 (or other components) may themselves be fluidly engaged or engageable together, such as via one or more flow connectors or loops, with any of the techniques and components described herein with respect to the blender manifolds 26 or in any other manner. Accordingly, all the details and corresponding illustrations relating to fluidly coupling and isolating multiple blender manifolds 26 herein are hereby incorporated by reference in their entireties with respect to and as if applied to multiple LP lines 20.

Referring back to FIGS. 4 & 5, in another independent aspect, one or more LP outlets 34 may be provided in or on, or associated with, one or more LP lines 20 in any suitable manner. For example, the LP outlet(s) 34 may be integrally formed into, or onto, one or more spools 38 of an LP line 20 or releasably engageable therewith without welding. In the present embodiment, the LP outlets 34 are provided on one or more carriers 40 releasably mechanically coupled to one or more spools 38 and/or other components of the LP line 20 without welding. In other embodiments, the carrier 40 may be integral with one or more spools 38 or other component (s) or welded thereto.

When included, the carrier 40 may have any suitable form, configuration, construction and operation. For example, the carrier 40 may include a connector spool or any other component(s) that can carry at least one LP outlet 34 and be fluidly coupled in, or to, an LP line 20. In the present embodiment, the carrier 40 includes a tee-assembly 41 having at least one LP outlet 34 and which is releasably engageable between, or with, adjacent spools 38 (and/or other components) in the LP line 20. The illustrated LP line 20 has a series of tee-assemblies 41 configured to be fluidly engaged between adjacent pairs of spools 38 (and/or other components). However, the carrier 40 could have any other form, configuration and components and be deployed in any other manner and location. For example, a carrier 40 may be engaged at one or both ends of the LP line(s) 20, two or more carriers 40 may be deployed side-by-side and engaged between a pair of spools 38, and so on.

Still referring to FIGS. 4 & 5, the carrier(s) 40 may likewise be engageable with one or more spools 38 and/or other components in any suitable manner. For example, one or more mechanical connectors 14, such as described above, may be used. In the present embodiment, the carrier 40 includes one or more receivers 29 (e.g., flanges 30) at each end thereof for releasable mechanical and fluid engagement with adjacent spools 38 (and/or other components) of the LP line 20. If desired, the illustrated receivers 29 may be integrally formed into or onto the carrier 40 without welding, such as through forging (molding, casting, machining or other processes). However, any other technique and arrangement of parts may be used for connecting the carriers 40 with the spools 38 and/or other components of the LP line 20. Further, the LP outlets 34 may be provided in or on, or associated with, the carrier 40, or LP line 20, with welds or in any other manner.

Referring specifically to FIG. 5, the exemplary LP line 20 may be configured so that the LP outlets 34 may be easily removed and repaired, modified, switched out or replaced (e.g., without welding), such as to due to damage thereto, to match the diameter of one or more hoses, pipes, couplings or other components connecting the frac pump 70 (e.g., FIG. 2) or other component and/or for any other purposes. This may be accomplished in any suitable manner. For example, the LP outlet 34 may include at least one (e.g., hammer union) adapter 43 or other component releasably mechanically engageable with the corresponding carrier 40. In the present embodiment, the adapter 43 is coupled to an adapter flange 58 engageable via fasteners 16 with one or more receivers 29 (e.g., flanges 30) integrally formed into or mechanically connected to the carrier 40. In other embodiments, the LP outlet 34 may be releasably coupled to the carrier 40 (or other component) with another form of connector (e.g., pins, clips, Chinese-finger-like portions, push-to-connect fittings (e.g., SharkBite™ fittings), snaps, ratchet or gripping portions, clamps, hubbed connections, threaded or otherwise mateable flanges, sleeves or other portions), and/or with the use of welds, or may instead be integral therewith, or otherwise not removable. In the illustrated embodiment, a valve 35 (e.g., butterfly valve assembly) with pneumatic actuator 37 is associated with the LP outlet 34, but the LP outlet 34 may have any other parts. Thus, the present disclosure is not limited to this arrangement of exemplary components and parts associated with the LP outlet 34, except and only to the extent as may be expressly specified otherwise herein or in a particular appended claim and only for such claim(s) and potentially one or more claims depending therefrom.

Referring briefly back to FIG. 4, in another independent aspect of the present disclosure, one or more of the respective components useful in, or associated with, the exemplary LP line(s) 20 could be universal or modular to allow for easy, streamlined, quick, and/or cost-efficient replacement, repair, deployment, storage, inventory management, shipping or on-site availability, for any other purposes or a combination thereof. In the present embodiment, all the respective spools 38 and/or carriers 40 useful to make up one or more LP lines 20 are universal (e.g., having a common size, length, weight, configuration, etc.) and reversible, or non-direction-specific, so that any such spool 38 and/or carrier 40 may be used at any location in any LP line 20 and accommodate fluid flow in either direction. If desired, the exemplary (LP) spools 38 may be configured so that a blender manifold 26, cap 36, carrier 40 or other component may be releasably coupled to either end of any spool 38 used in an LP line 20. For yet another example, all the respective blender manifolds 26, LP inlets 24 and/or LP outlets 34 useful in or with one or more LP lines 20 may be universal (e.g., having a common respective size, length, weight, configuration, etc.) to allow their interchangeable use at any desired appropriate location (e.g., the blender manifold 26 at either end of any spool 38, LP line 20 or other component; the LP inlet 24 at any appropriate location on any blender manifold 26, blender block extension or other component; LP outlet 34 at any location on any LP carrier 40 or other component).

In instances where different versions (e.g., types, sizes, ratings) of any of the exemplary LP components (e.g., spools 38, carriers 40, blender manifolds 26, LP inlets 24 and/or LP outlets 34) are needed or desired, such as to fit different sized frac or well equipment, accommodate the particular needs at a job site, make up different versions of LP lines 20 and/or for any other purposes, the members of each version of a particular component may be universal.

For still another example, a common or universal form of connection mechanism and/or technique(s) (e.g., tools) for interconnecting different types of components may be used. In the present embodiment, the same form of mechanical connectors 14 can be used for interconnecting all, or substantially all, of the various components and sub-components (e.g., spools 38, carriers 40, LP inlets 24, LP outlets 34, spacer spools 32, blender manifolds 26, blender blocks 28, caps 54, caps 36, valves 33, 35 and 42, caps 36 and 54, adapters 43, adapter spools 46, adapter flanges 58, spacer spools 59) of the LP line 20. Moreover, the mechanical connectors 14 (e.g., flange 30, hub, threads) associated with all, or substantially, all of the various components and sub-components of the LP line 20 may be integrally formed therewith (e.g., via forging, molding, casting, machining or other processes) or mechanically coupled thereto (e.g., via threadable connection) to avoid welding. (In some cases, some welding may be used.) Further, the exemplary LP line 20 itself may be universal and/or reversible (non-direction-specific) and used at any location and in any configuration on a missile skid 10 or in a frac missile 56 and accommodate fluid flow in either direction.

Referring back to FIGS. 1 & 2, in yet another independent aspect, the exemplary HP side 21, HP and line(s) 22 and components thereof (e.g., spools 38, HP inlets 64, HP outlets 66) may have any, all or none of the features, sub-components, configurations, capabilities and other details as provided herein with respect to the LP side and line(s) 19, 20, except (i) with regard to any necessary or desired modification thereto for use in a high pressure fluid flow situation or application (e.g., having HP fluid flow therethrough from the frac pump(s) 70 to the well(s) 76), or (ii) to the extent any such features, sub-components, configurations, capabilities or other details may be unnecessary or incompatible for use in a HP line 22. For example a carrier 40 useful on the HP line 20 may include a cross-block assembly or studded cross-block. Accordingly, other than with respect to any such exceptions, the entire description above and the associated drawings (e.g., FIGS. 1, 2, 4-12) with respect to the LP side 19 and LP line(s) 20 are hereby incorporated by reference herein in their entireties with respect to the HP side 21, HP line(s) 22.

In various embodiments, any of the components and subcomponents of the LP lines 20 and/or HP lines 22 (e.g., spools 38, carriers 40, LP inlets 24, LP outlets 34, HP inlets 64, HP outlets 66, spacer spools 32, blender manifolds 26, blender blocks 28, caps 54, caps 36, valves 33, 35 and 42, caps 36 and 54, adapters 43, adapter spools 46, adapter flanges 58, spacer spools 59) may be constructed of any suitable, appropriately pressure-rated, material depending upon the component and application, such as for example, steel, hard piping, flexible pipe, flexible hose, rigid hose, poly pipe, thermoplastic and the like. In addition, in many embodiments, any such components may themselves be formed integrally without welding and configured to be releasably mechanically coupled to other components without welding, while other embodiments may involve welding.

Figure 11:
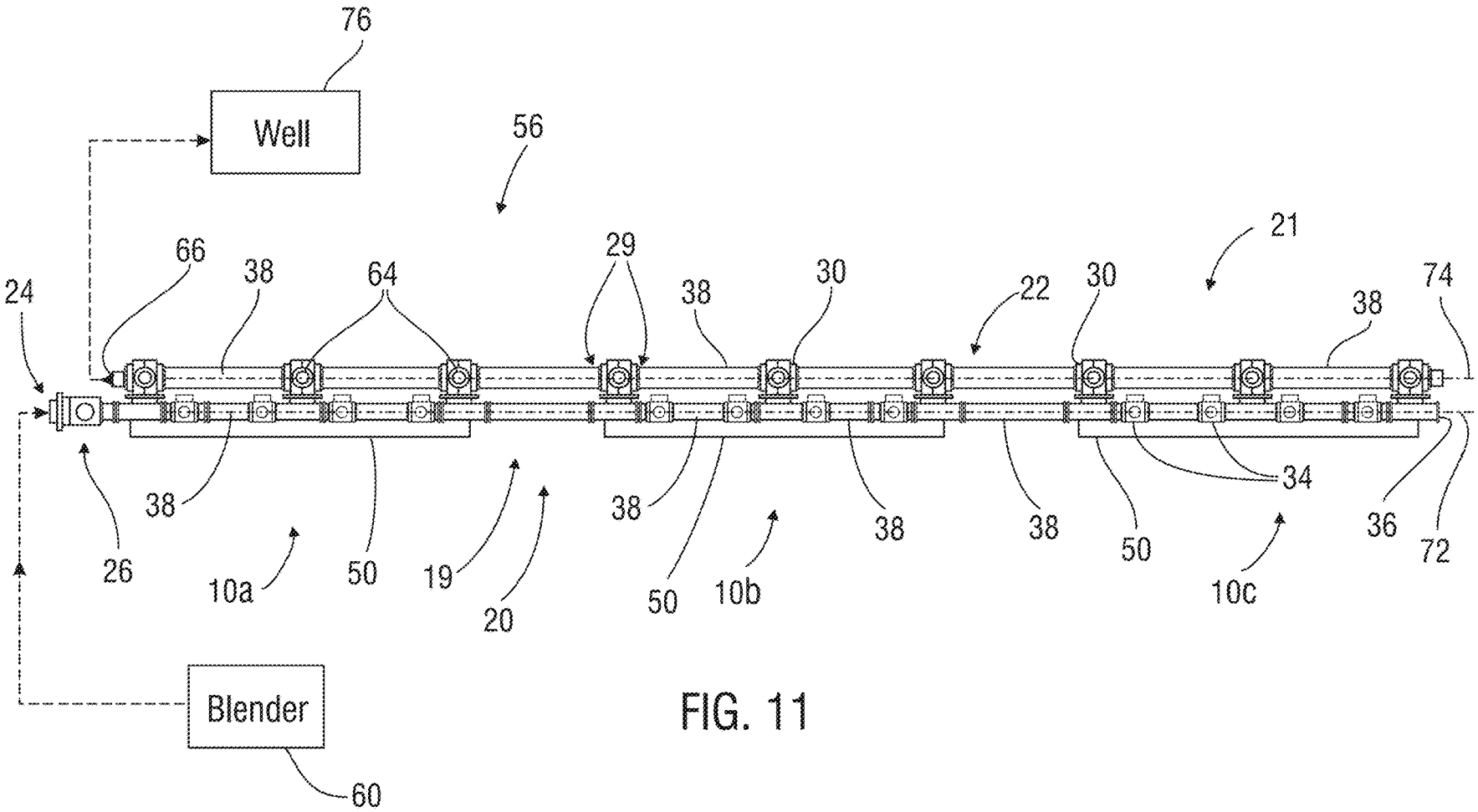
FIG. 11 is a side view of an exemplary frac missile having a blender skid, middle skid and end skid in accordance with one or more embodiments of the present disclosure.
Figure 12:
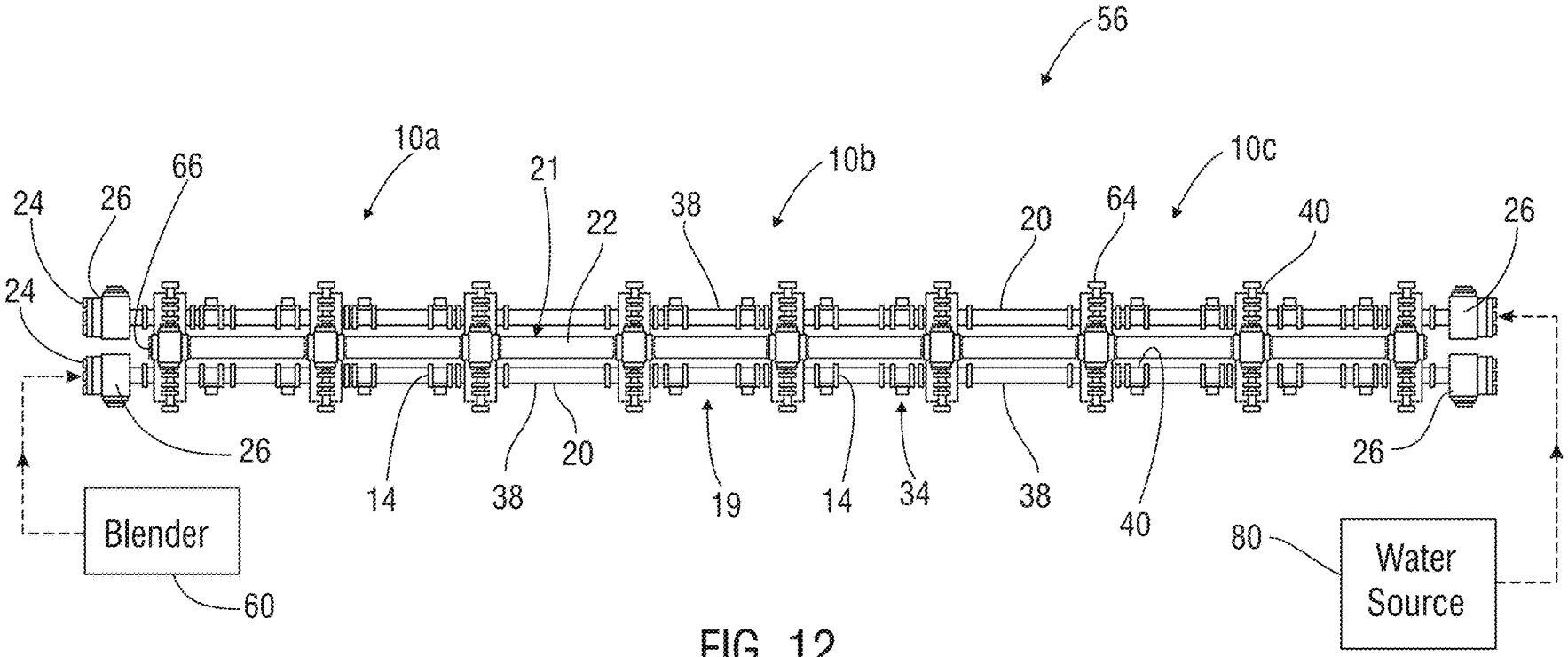
FIG. 12 is a top view of an exemplary frac missile having a blender skid, middle skid and end skid in accordance with one or more embodiments of the present disclosure.

In another independent aspect, each exemplary frac missile skid 10 may be a single module, or unit, and itself serve as a frac missile 56 (e.g., FIGS. 1 & 2) or be coupled with other frac missile skids 10 to form a frac missile 56 (e.g., FIGS. 11 & 12). If desired, the exemplary missile skid 10 may be universal and reversible, or non-direction-specific, so it may be used at any location and in any orientation (accommodating fluid flow in either direction) in a frac missile 56. In the present embodiment, the missile skids 10 are interchangeable and easily releasably mechanically and fluidly coupled together and decoupled without welding so that any number of missile skids 10 may be easily and quickly connected together in any configuration, disconnected, removed and replaced, etc. For example, at some job sites, as few as only one or two extra, or replacement, missile skids 10 can be kept on hand if needed to replace any skid 10 at any location in the frac missile 56 or add thereto.

In FIGS. 11 & 12, the illustrated missile skid 10*a* on the left is releasably connectable to a frac blender 60 and is sometimes referred to as the blender skid 10*a*. At the other end of the illustrated frac missile 56, the right-most missile skid 10*b* is sometimes referred to as the end skid 10*b*. Between the exemplary blender and end skids 10*a*, 10*b* may be one or more other missile skids 10, sometimes referred to as middle skids 10*c*. However, any other configuration, with any desired number (e.g., 1, 2, 4 or more) of missile skids 10 is possible. For example, the skids 10*a*, 10*b* could be reversed, with the blender skid 10*a* on the right and the end skid 10*b* on the left. For another example, the LP line 20 on both skids 10*a*, 10*b* may be easily releasably connectable or connected to one or more frac blenders 60 (or other components, such as a water source 80). Further, the LP and/or HP lines 20, 22 on any of the exemplary missile skids 10 could be easily releasably connected to other desired appropriate components. Moreover, in the present embodiment, one or more missile skids 10 may be easily removed from or added to the frac missile 56 without welding.

In the frac missile 56 of FIG. 11, the illustrated LP line 20 includes a blender manifold 26 engageable with one or more frac blenders 60 at one end (on the blender skid 10*a*) and a cap 36 (e.g., blind, or pancake-style, flange) to cap, or close off, the LP line 20 at the other end (on the end skid 10*b*). In FIG. 12, two exemplary LP lines 20 include respective blender manifolds 26 at both ends thereof so that either, or both, skids 10*a*, 10*b* may be used as the blender skid or end skid and/or be coupled to other equipment (e.g., water source 80). In this instance, one or more frac blenders 60 (water sources 80 or other components) may thus be coupled to the frac missile 56 at either or both ends, providing great versatility in use at the job site and/or for any other purposes. In some embodiments, only one of multiple available blender manifolds 26 may be coupled to a frac blender 60 and the others used for a different purpose or not used. For another example, a single frac blender 60 may be coupled to two blender manifolds 26 on the LP side 19 of a frac missile 56. Other configurations may include only one blender manifold 26 coupled to only one LP line 20, both LP lines 20 or more than two LP lines 20. In yet other configurations, when the missile skids 10 in the frac missile 56 includes at least two LP lines 20, a flow connector or loop, or other component fluidly connecting two or more of the LP lines 20 may be provided at one end (e.g., end skid 10*b*) or at an intermediate location.

IT IS RECOMMENDED THAT ALL RELEVANT SAFETY PROCEDURES AND PROTOCOLS, REGULATORY STANDARDS AND REQUIREMENTS, OTHER COMPLIANCE STANDARDS AND THE SPECIFICATIONS, RECOMMENDED OPERATING, REPAIR AND MAINTENANCE PROCEDURES AND OTHER RECOMMENDATIONS, INSTRUCTIONS, REPRESENTATIONS, ASSEMBLY AND USE GUIDELINES AND ADVICE OF OEMS, EQUIPMENT USERS, OPERATORS AND ANY OTHER RELEVANT PARTIES BE FOLLOWED AND NOT BE COMPROMISED WHEN PRACTICING ANY OF THE TEACHINGS OF THIS PATENT.

Preferred embodiments of the present disclosure thus offer advantages over the prior art and are well adapted to carry out one or more of the objects of this disclosure. However, the present disclosure does not require each of the components and acts described above and is in no way limited to the above-described embodiments and methods of operation. Any one or more of the above components, features, aspects, capabilities and processes may be employed in any suitable configuration without inclusion of other such components, capabilities, aspects, features and processes. Accordingly, embodiments of the present disclosure may have any one or more of the features described or shown in this patent. Moreover, the present invention includes additional features, capabilities, functions, methods, uses and applications that have not been specifically addressed herein but are, or will become, apparent from the description herein, the appended drawings and claims.

The methods that may be described above, claimed herein or are apparent from this patent and any other methods which may fall within the scope thereof can be performed in any desired or suitable order and are not necessarily limited to any sequence described herein or as may be listed in any appended claims. Further, the methods of various embodiments of the present disclosure may include additional acts beyond those mentioned herein and do not necessarily require use of the particular embodiments shown and described herein, but are equally applicable with any other suitable structure, form and configuration of components.

While exemplary embodiments have been shown and described, many variations, modifications and/or changes of the system, apparatus, articles of manufacture and methods of the present disclosure, such as in the features, components, details of construction and operation and arrangements thereof and the manufacture, assembly and use thereof, are possible, contemplated by the present patentee, within the scope of any appended claims, and may be made and used by one of ordinary skill in the art without departing from the spirit, teachings and scope of this disclosure and any appended claims. Thus, all matter herein set forth or shown in the accompanying drawings should be interpreted as illustrative and the scope of this disclosure and any appended claims should not be limited to the embodiments described or shown herein.

The invention claimed is:

1. A hydraulic fracturing missile comprising:

a low pressure side having a first suction conduit, at least one suction inlet and at least one suction outlet, the at least one suction inlet being configured to fluidly couple the first suction conduit to at least one frac blender and the at least one suction outlet being configured to fluidly couple the first suction conduit to at least one frac pump, whereby fluid can pass from the at least one frac blender, through at least one suction inlet into the first suction conduit and thereafter through at least one suction outlet to at least one frac pump, wherein the first suction conduit includes multiple suction conduit spools releasably, longitudinally, mechanically and fluidly interconnectable and separable without welding, further wherein the at least one suction inlet and the at least one suction outlet are releasably mechanically and fluidly connectable to and separable from the first suction conduit without welding.

2. The hydraulic fracturing missile of claim 1 wherein the suction conduit spools are reversible and interchangeable, whereby each suction conduit spool is releasably mechanically and fluidly connectable to and separable from any other suction conduit spool and can allow fluid flow therethrough in either direction.

3. The hydraulic fracturing missile of claim 2 wherein each suction conduit spool has first and second ends, whereby a flange is provided at or proximate to each end of each suction conduit spool.

4. The hydraulic fracturing missile of claim 3 wherein the respective flanges of each suction conduit spool are forged therewith.

5. The hydraulic fracturing missile of claim 1 wherein each suction conduit spool is releasably mechanically and fluidly connectable to and separable from any other suction conduit spool with at least one mechanical connector.

6. The hydraulic fracturing missile of claim 5 wherein the at least one mechanical connector includes at least one fastener.

7. The hydraulic fracturing missile of claim 6 wherein the at least one mechanical connector includes at least one receiver provided on at least one suction conduit spool and configured to receive at least one fastener.

8. The hydraulic fracturing missile of claim 7 wherein each suction conduit spool includes at least one receiver formed integrally therewith.

9. The hydraulic fracturing missile of claim 7 wherein each receiver includes at least one flange.

10. The hydraulic fracturing missile of claim 5 wherein the hydraulic fracturing missile includes a plurality of missile skids configured to be releasably, longitudinally interconnectable and separable without welding, wherein the first suction conduit extends at least partially across first and second missile skids and includes at least first and second suction conduit spools disposed upon the first missile skid and at least third and fourth suction conduit spool disposed upon the second missile skid, the first and second suction conduit spools being releasably interconnectable and separable with at least one mechanical connector without welding and the third and fourth suction conduit spools being releasably interconnectable and separable with at least one mechanical connector without welding.

11. The hydraulic fracturing missile of claim 10 wherein the plurality of missile skids are interchangeable, modular, reversible and longitudinally interconnectable in any sequence without welding.

12. The hydraulic fracturing missile of claim 1 wherein at least one suction outlet is disposed on a suction outlet carrier, each suction outlet carrier being releasably mechanically and fluidly connectable to and separable from any suction conduit spool without welding.

13. The hydraulic fracturing missile of claim 12 wherein each suction outlet carrier is releasably mechanically and fluidly connectable to and separable from any suction conduit spool with at least one mechanical connector.

14. The hydraulic fracturing missile of claim 13 wherein at least one suction outlet carrier is releasably mechanically and fluidly connectable between a pair of longitudinally aligned suction conduit spools and separable therefrom without welding.

15. The hydraulic fracturing missile of claim 1 wherein at least one suction inlet is disposed on a blender manifold, the blender manifold being configured to be releasably mechanically and fluidly connectable to and separable from at least one suction conduit spool without welding.

16. The hydraulic fracturing missile of claim 15 wherein the blender manifold is releasably mechanically and fluidly connectable to and separable from at least one suction conduit spool with at least one mechanical connector.

17. The hydraulic fracturing missile of claim 15 wherein the blender manifold includes at least first and second separate and distinct support surfaces, each support surface configured to host multiple suction inlets.

18. The hydraulic fracturing missile of claim 15 wherein the blender manifold is a square or rectangular blender block having at least four sides, wherein at least two sides of each blender block include at least one at least substantially flat support surface configured to host multiple suction inlets.

19. A system for forming a suction conduit for a hydraulic fracturing missile, the system comprising:

a plurality of universal, interchangeable and reversible suction conduit spools configured to be releasably, longitudinally, mechanically and fluidly interconnectable and separable without welding;

a plurality of universal blender manifolds each configured to carry multiple suction inlets and being releasably, mechanically and fluidly engageable with and separable from any suction conduit spool without welding; and a plurality of universal, interchangeable and reversible suction outlet carriers each carrying at least one suction outlet and being releasably, mechanically and fluidly engageable with and separable from any suction conduit spool without welding.

20. The system of claim 19 wherein the suction outlet carrier includes at least one T-shaped pipe.

21. The system of claim 19 wherein each suction conduit spool, blender manifold and suction outlet carrier has first and second ends, further including a plurality of universal, interchangeable, interconnectable mechanical connectors, at least one mechanical connector being provided at or proximate to each respective ends of each suction conduit spool and suction outlet carrier and at or proximate to the second end of each blender manifold, whereby any blender manifold can be coupled to either end of any suction conduit spool and either end of any suction outlet carrier can be coupled to either end of any suction conduit spool.

22. The system of claim 21 wherein each mechanical connector includes at least one flange.

* * * * *